US005174218A

United States Patent [19]

List

[11] Patent Number: 5,174,218

[45] Date of Patent: Dec. 29, 1992

[54] SELF-STEERING TRUCKS WITH SIDE BEARINGS SUPPORTING THE ENTIRE WEIGHT OF THE VEHICLE

[75] Inventor: Harold A. List, Bethlehem, Pa.

[73] Assignee: Railway Engineering Associates, Inc., Baltimore, Md.

[21] Appl. No.: 672,698

[22] Filed: Mar. 18, 1991

Related U.S. Application Data

[60] Continuation-in-part of Ser. No. 455,980, Dec. 22, 1989, Pat. No. 5,000,097, which is a continuation-in-part of Ser. No. 127,558, Dec. 2, 1987, Pat. No. 4,889,054, which is a continuation of Ser. No. 822,631, Jan. 27, 1986, abandoned, which is a division of Ser. No. 623,189, Jun. 21, 1984, Pat. No. 4,655,143, which is a continuation-in-part of Ser. No. 948,878, Oct. 5, 1978, Pat. No. 4,455,946, which is a continuation-in-part of Ser. No. 608,596, Aug. 28, 1975, Pat. No. 4,131,069, which is a continuation-in-part of Ser. No. 438,334, Jan. 31, 1974, abandoned, which is a continuation-in-part of Ser. No. 222,999, Feb. 2, 1972, Pat. No. 3,789,770, which is a continuation of Ser. No. 882,359, Dec. 15, 1969, abandoned, which is a continuation of Ser. No. 680,257, Nov. 2, 1967, abandoned.

[51] Int. Cl.[5] ..... B61F 5/14; B61F 5/38

[52] U.S. Cl. ..... 105/167; 105/185; 105/199.3

[58] Field of Search ..... 105/165, 167, 168, 171, 105/179, 185, 190.1, 190.2, 197.05, 199.1, 199.3, 199.4, 200, 201

[56] References Cited

U.S. PATENT DOCUMENTS

| | | | |
|---|---|---|---|
| 1,276,188 | 8/1918 | Dietz | 105/200 X |
| 1,883,385 | 10/1932 | Martin | 105/197.05 |
| 3,350,146 | 12/1964 | Williams | 105/199.3 X |
| 3,358,615 | 12/1967 | Williams | 105/199.4 X |
| 3,528,374 | 9/1970 | Wickens | 105/165 X |
| 3,570,410 | 3/1971 | Stein | 105/199.4 |
| 3,670,660 | 6/1972 | Weber et al. | 105/171 |
| 4,030,424 | 6/1977 | Garner et al. | 105/197.05 |
| 4,108,080 | 8/1978 | Garne et al. | 105/197.05 X |
| 5,000,097 | 3/1991 | List | 105/199.3 |

*Primary Examiner*—Robert J. Oberleitner
*Assistant Examiner*—S. Joseph Morano
*Attorney, Agent, or Firm*—Synnestvedt & Lechner

[57] ABSTRACT

A vehicle truck embodying articulated subtrucks or steering arms having a plurality of wheelsets, with steering arm interconnections establishing coordinated steering motions of the wheelsets, the truck also having elastic restraining devices for stablilizing steering and other motions of conventional rotating axle wheelsets and still further having linkage interrelating relative lateral motions of the truck and body of the vehicle, which add to the stability and steering to trucks having rotating axle wheelsets and which will provide steering for wheelsets equipped with independently rotatable wheels. A method and structure is provided for adapting or "retrofitting" existing equipped truck structures with rotating axle wheelsets in a manner to enhance the steering and stablilizing characteristics. Four-point suspension of car bodies and truck side frames adapted to function as swing hangers in truck equipped with steering is disclosed.

8 Claims, 22 Drawing Sheets

29
35
18
18
25
25a
SR
44
10
48
11
51
℄
℄
49
52
50
VB
12
13
SR
18
18
29

29
LF
35
18
18
25
SR
25a
44
10
11
52
51
℄
℄
49
50
48
12
SR
18
18

Fig. 9.
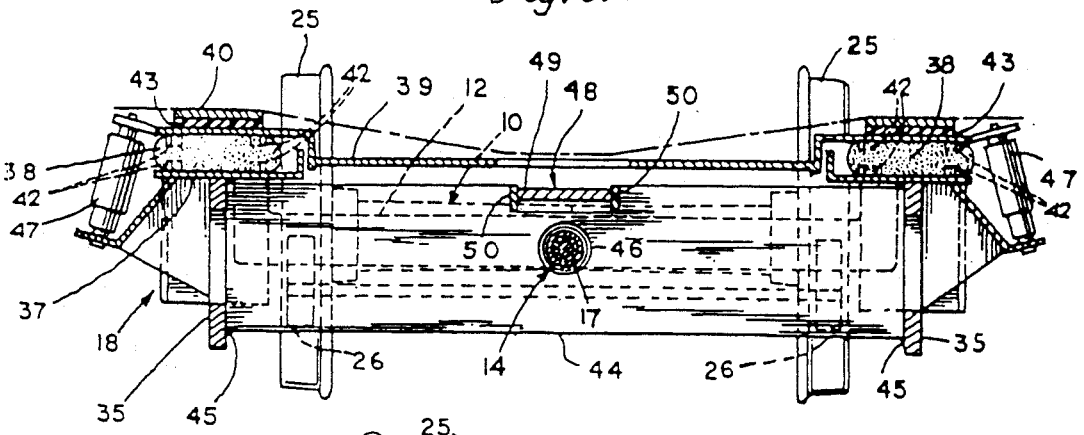
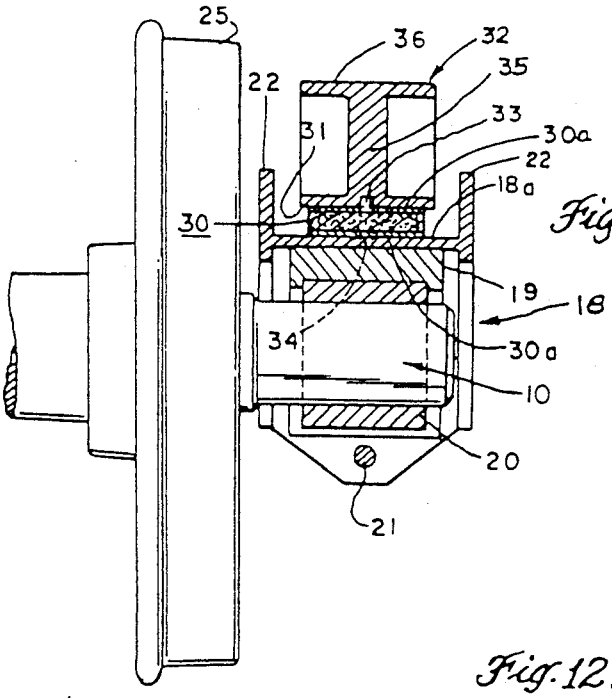
Fig. 10.
Fig. 11.
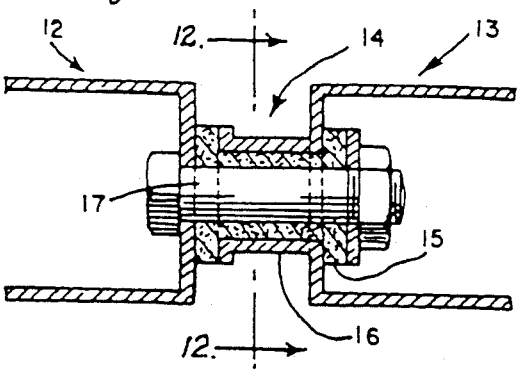
Fig. 12.
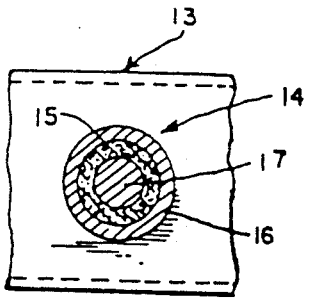

Fig. 13.
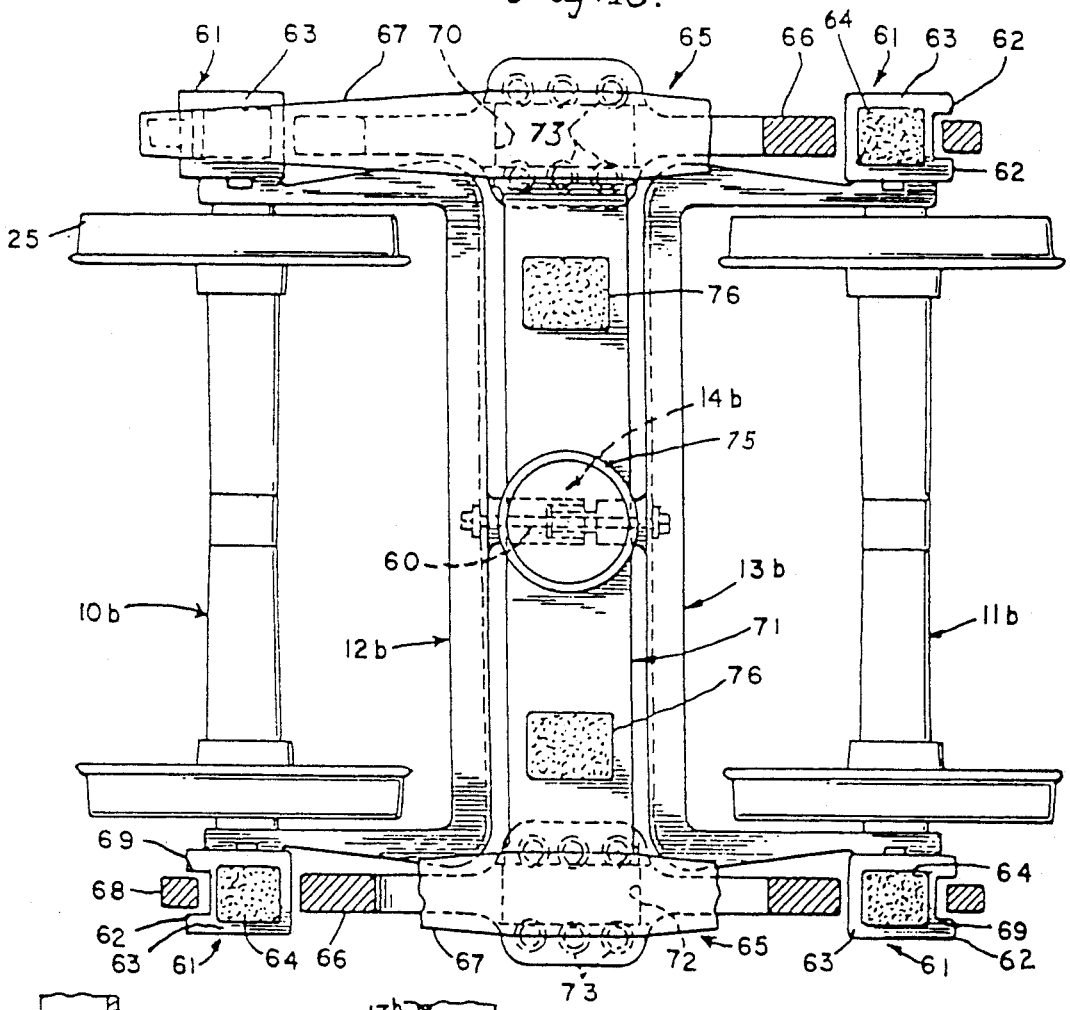
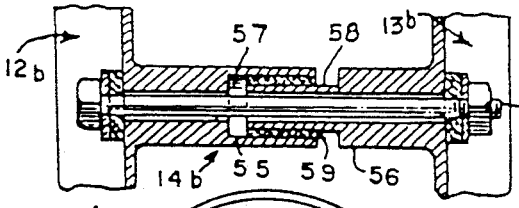
Fig. 15.
Fig. 14.
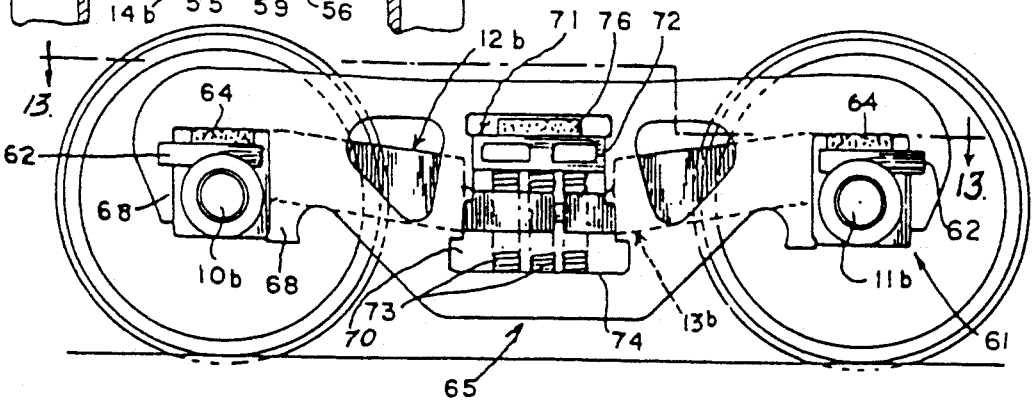

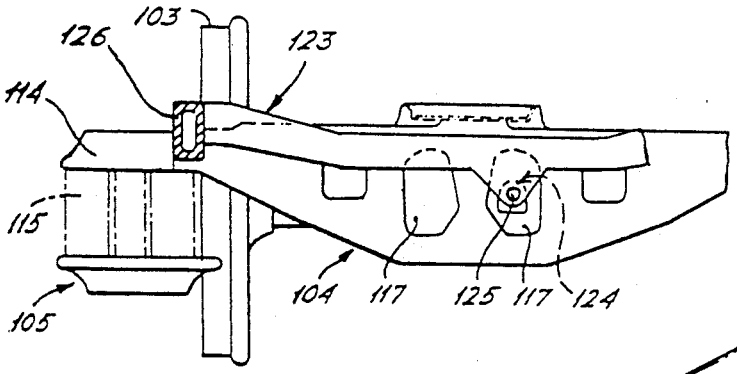
FIG. 18.
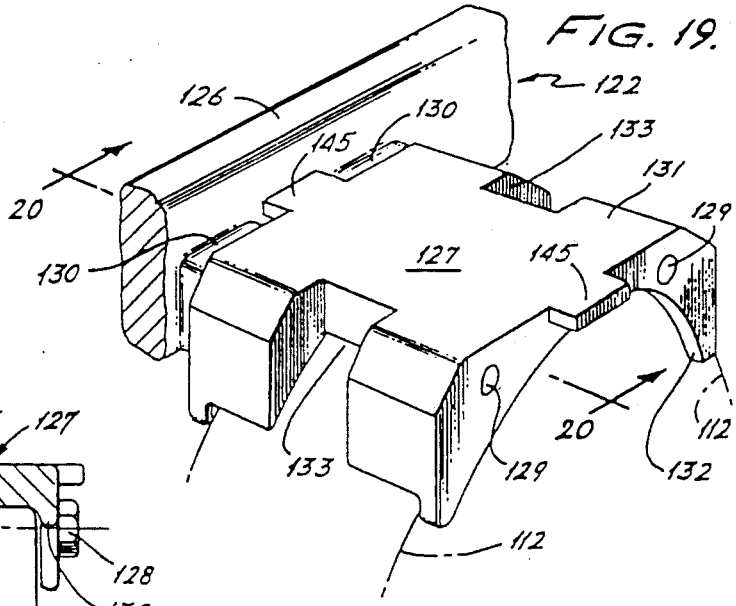
FIG. 19.
FIG. 20.
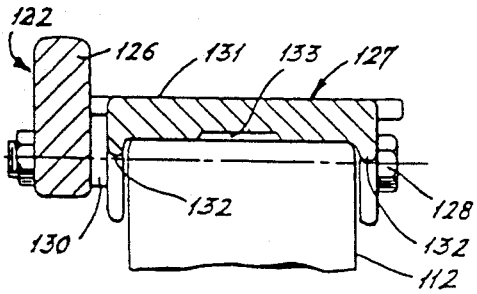
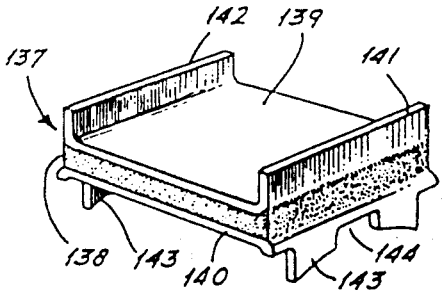
FIG. 22.
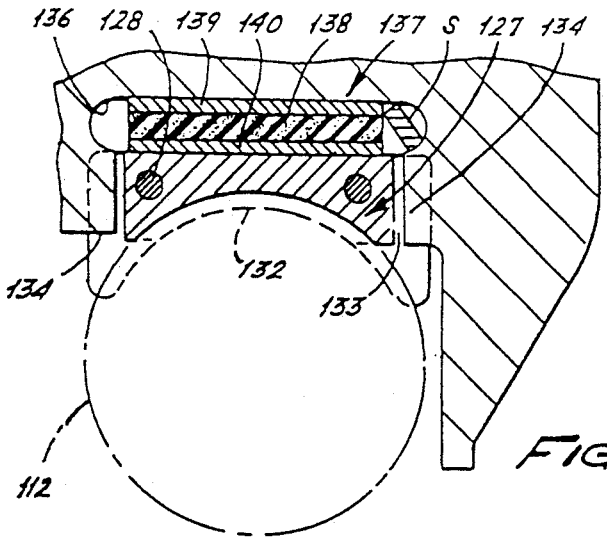
FIG. 21.

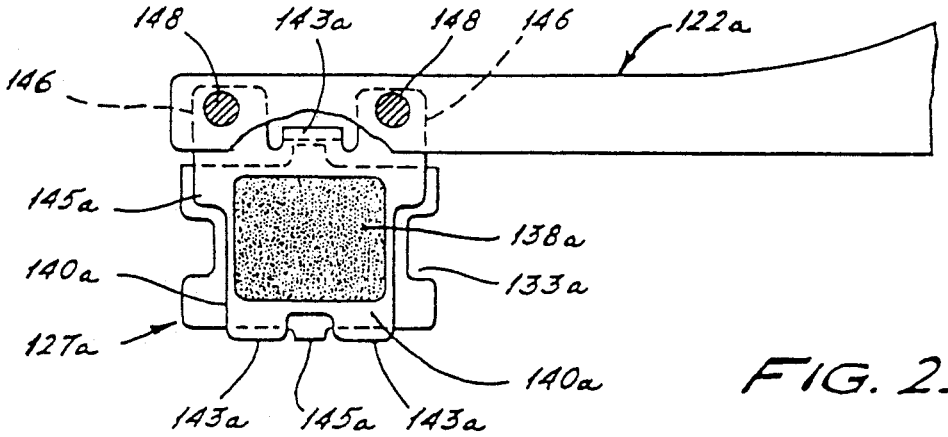
FIG. 23.
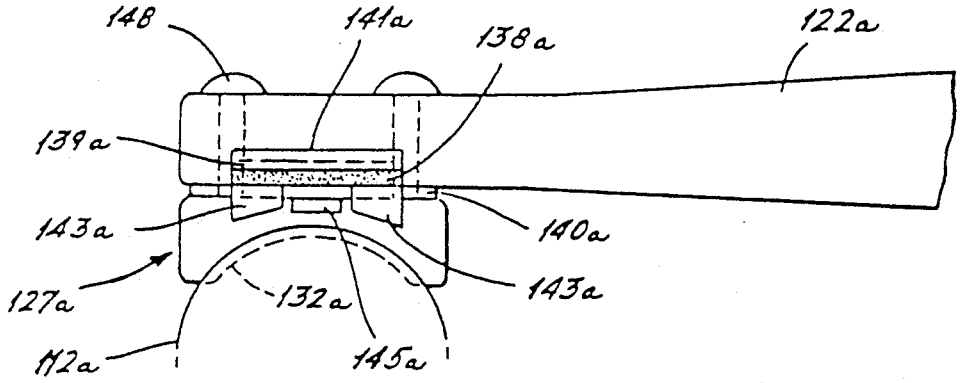
FIG. 24.
FIG. 25.
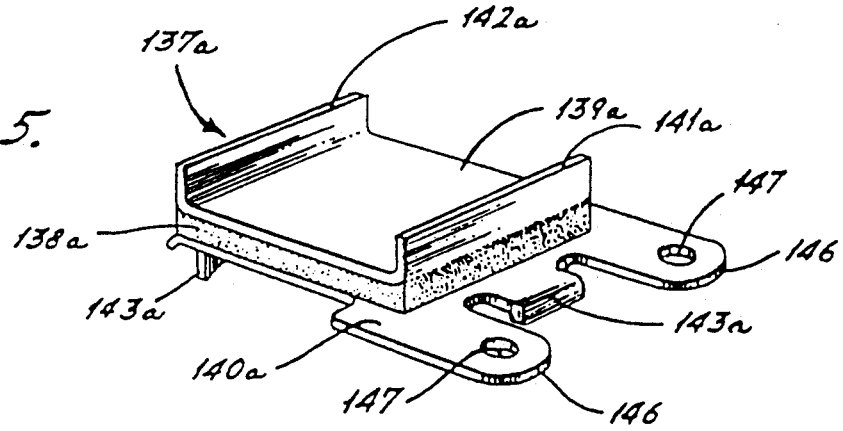

FIG. 34
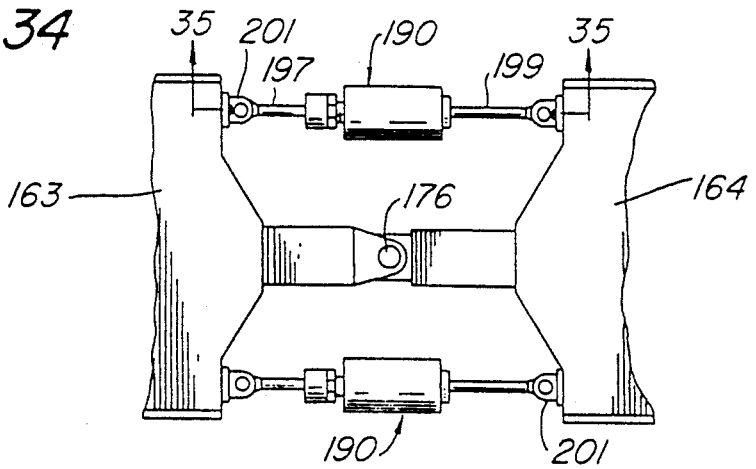
FIG. 35
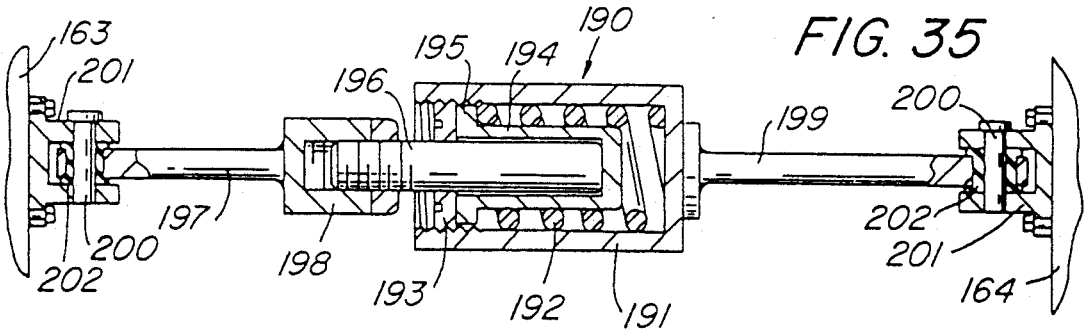
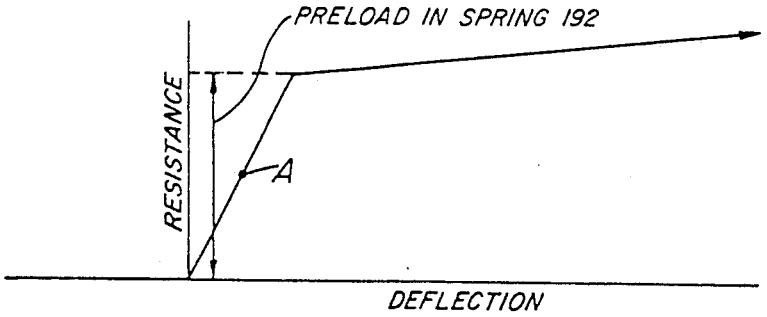
FIG. 36

FIG. 41
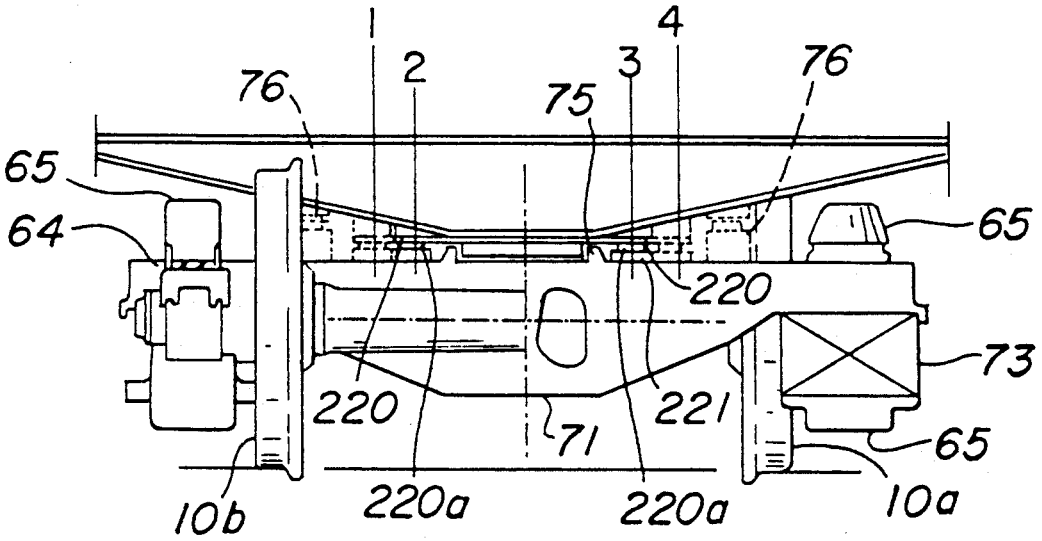
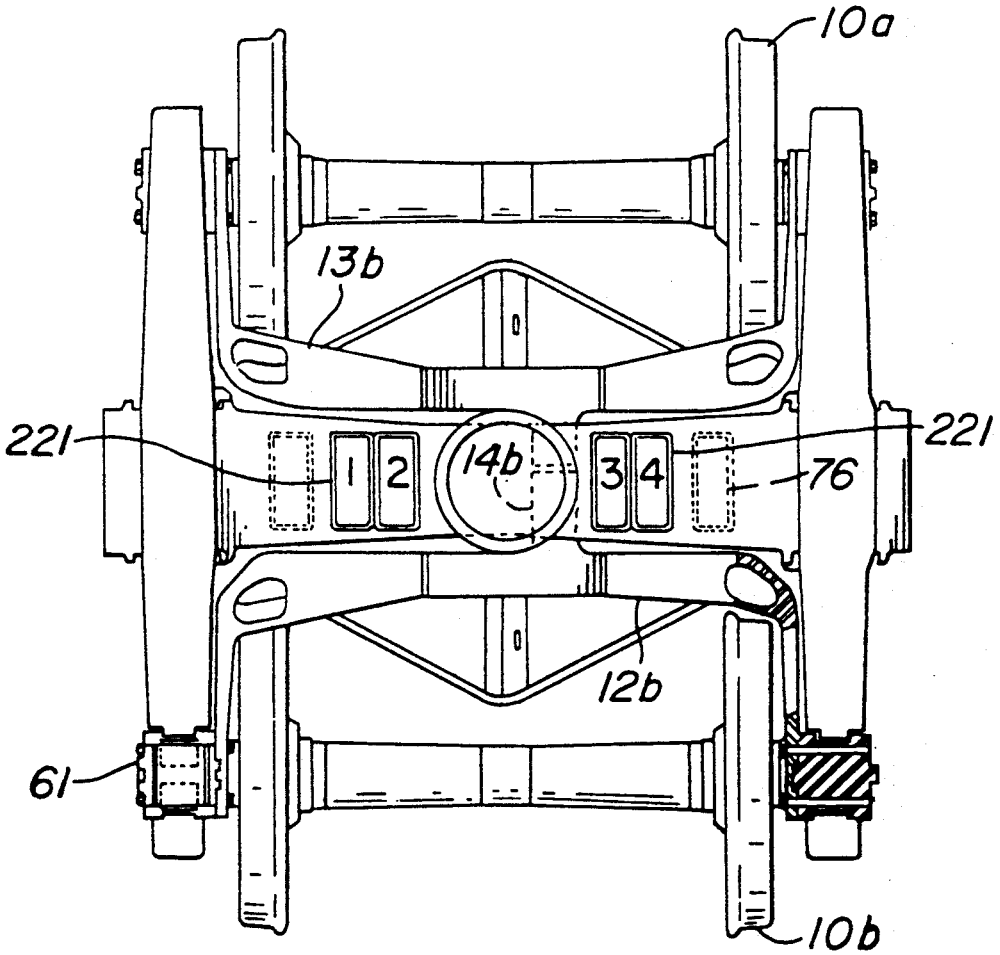
FIG. 42

SELF-STEERING TRUCKS WITH SIDE BEARINGS SUPPORTING THE ENTIRE WEIGHT OF THE VEHICLE

CROSS REFERENCES

This application is a continuation-in-part of my application Ser. No. 07/455,980 filed on Dec. 22, 1989, now U.S. Pat. No. 5,000,097, which is a continuation-in-part of my application Ser. No. 07/127,558 filed on Dec. 2, 1987, now U.S. Pat. No. 4,889,054, issued Dec. 26, 1989, which is continuation of my copending application Ser. No. 06/822,631 filed on Jan. 27, 1986, now abandoned, which is a divisional of my pending application Ser. No. 06/623,189 filed Jun. 21, 1984, issued Apr. 7, 1987 as U.S. Pat. No. 4,655,143, which is a continuation-in-part of my prior application Ser. No. 05/948,878 filed Oct. 5, 1978, issued Jun. 26, 1984 as U.S. Pat. No. 4,455,946, which is a continuation-in-part of my prior application Ser. No. 05/608,596 filed Aug. 28, 1975, issued Dec. 26, 1978 as U.S. Pat. No. 4,131,069, and which is a continuation-in-part of my prior application Ser. No. 05/438,334 filed Jan. 31, 1974, now abandoned, which is a continuation-in-part of Ser. No. 222,999 filed on Feb. 2, 1972, issued Feb. 5, 1974 as U.S. Pat. No. 3,789,770, which is a continuation of Ser. No. 882,359 filed Dec. 15, 1969, now abandoned, which is a continuation of Ser. No. 680,257 filed Nov. 2, 1967, now abandoned.

TABLE OF CONTENTS OF SPECIFICATION

CROSS REFERENCES
BACKGROUND AND SUMMARY OF THE INVENTION
BRIEF DESCRIPTION OF THE DRAWINGS
FORCE AND MOTION DIAGRAMS
FIRST EMBODIMENT
SECOND EMBODIMENT
THIRD EMBODIMENT
FOURTH EMBODIMENT
PRIOR ART AAR TRUCK
FIRST EMBODIMENT STEERING ACTION
FIFTH EMBODIMENT AND ITS STEERING ACTION
SIXTH EMBODIMENT
SEVENTH EMBODIMENT
DETAILED DESCRIPTION
FORCE AND MOTION DIAGRAMS
FIRST EMBODIMENT
FIRST EMBODIMENT STEERING ACTION
SECOND EMBODIMENT
PRIOR ART AAR TRUCK
FOURTH EMBODIMENT AND RETROFITTING
BRAKE RIGGING
FIFTH EMBODIMENT
FIFTH EMBODIMENT STEERING ACTION
SIXTH EMBODIMENT
SEVENTH EMBODIMENT
EIGHTH and NINTH EMBODIMENT
CLAIMS

BACKGROUND AND SUMMARY OF THE INVENTION

Railway vehicles conventionally use rotating axle wheelsets in which the two flanged wheels are firmly attached to the axle and therefore are required by torque in the axle to turn at the same speed. Alternatively, rail vehicles can be equipped with wheelsets in which the wheels can rotate independently with little or no exchange of torque through the axle.

Both new and worn wheel treads typically provide a slightly larger rolling radius on the load carrying portion of the tread near the flange than on the portion of the tread which is remote from the flange and also further from the track centerline.

When the wheels are conventionally attached to a rotating axle by a rigid press fit, the wheelset has a self-steering property which will tend to steer the wheelset toward the centerline of tangent track when the wheelset is displaced laterally. This self-steering property will also provide steering toward the radial position in gradual curves. However, the self-steering property has the serious disadvantage that it tends to cause lateral oscillation of the wheelset with respect to the track centerline at high speeds. In addition, all railroads contain some curves and some railroads contain many curves in which the differential rail length is greater than can be accommodated by the differential radius of the two wheels in the set. In this case, the wheelset must be steered around the curve by a steering moment supplied by the truck framing. In sharp curves, the required steering moment becomes quite large.

An alternative wheelset configuration allows for independent rotation of the wheels with little or no torque exchanged through the axle. In some cases, the axle may not rotate at all. This type of wheelset has the advantage that it does not have a tendency to lateral oscillation even at very high speeds. However, the self-steering property of the conventional wheelset is also lost, and the wheelset must be steered by the truck framing at all times. In contrast to trucks having fixed wheel sets, the steering moment required is very small even in very sharp curves.

In one aspect, the present application is concerned with the adaptation of many features of the parent applications referred to above to trucks equipped with conventional rotating axle wheelsets. By virtue of such adaptation, it is possible to utilize features of the invention to retrofit existing railroad trucks as well as apply the invention to the design of new trucks.

In another aspect, the present application is concerned with utilizing features of the invention to provide axle steering to wheelsets having wheels which are able to rotate independently and therefore lack a significant self-steering ability.

The axle steering features of particular value to rail vehicles having independently rotatable wheels can also be applied to the field of highway vehicles which conventionally have independently rotatable wheels and where use of certain steering features of the invention can reduce lateral scrubbing of the tires and reduce the width of the roadway required for negotiating curves with long trailers.

Because the various aspects of my invention are especially useful in railway vehicles and particularly in railway trucks having a plurality of axles, the invention will be illustrated and described with specific reference to railway rolling stock.

The axles of nearly all of the railway trucks now in general use are rigidly constrained to remain substantially parallel at all times (viewed in plan). Passenger car and locomotive trucks conventionally also require the axles to be elements of a rectangle. Most of the freight car trucks now in general service do not constrain the wheelsets closely to the rectangular pattern and allow the wheelsets to run in a parallelogrammed position. In addition, the tolerances observed in freight car truck manufacture often do not provide adequate precision of the parallel position for low rolling resistance on tangent track.

Theoretically, a precisely parallel orientation of the wheelsets is sufficient for low rolling resistance at low speed on tangent track. However, this is not adequate for operation at the high speeds and high axle loads which are rapidly becoming commonplace around the world.

One undesirable result of allowing the axles to parallelogram is truck hunting. This leads to many undesirable and dangerous results such as lading damage, damage to the car structure and occasional derailments. The derailment hazard is due in part directly to the high wheel/rail forces present during hunting and indirectly to the cumulative track damage done by these forces.

Another undesirable result of restraining the axles to be parallel is having the lead axle run with a substantial angle of attack against the outer rail in curves, causing objectionable noise and excessive wear of both flanges and rails. This operation also presents a derailment hazard. The hazard is due in part to high flange climbing forces associated with the wheel/rail angle of attack and in part to the cumulative damage done to the track by the high forces.

Recent efforts by others to overcome the stability problem of conventional trucks have concentrated on restraining the parallel yaw motion of the two axles by restraining the yaw motion of the truck bolster relative to the vehicle. This is done by means of constant contact side bearings which apply a substantial friction force longitudinally between the car body and the bolster at a location approximately two feet removed from the point of truck swivel. While this measure will provide some suppression of truck hunting, curving is made worse, and there is usually a noticeable increase in flange wear. In addition, the service life of constant contact side bearings is relatively short. This is in contrast to trucks of this invention which have a very long service life and require very little maintenance.

Another approach to the hunting problem has been the introduction of devices for rigidizing the truck frame to prevent parallelogramming of the wheelsets. Tests have shown that truck hunting is also suppressed, but again, curving is made worse.

A third approach to the hunting problem has involved rigidizing the truck frame plus the use of resilient pads between the truck framing and the wheelsets. This will allow a limited measure of self-steering of conventional rotating axle wheelsets. However, some of these designs provide such limited suppression of truck hunting that constant contact side bearings are still required. On the other hand, one truck frame rigidizing design described and claimed in my U.S. Pat. No. 4,483,253 has proven to be relatively successful without requiring constant contact side bearings. As a result, this configuration has a long service life. However, the suppression of truck hunting is still not as effective as with the present invention, and the improvement in curving has a more limited range.

For the purposes of this disclosure, the term "yaw" stiffness is defined as the restraint of the wheelsets relative to the truck framing in the yaw direction. In the apparatus of the invention, yaw stiffness is provided in part by the elastomeric shear pads and in part by direct elastic connections between the two steering arms and elastic connections between one of the axles and the car body which may involve connections between the car body and the truck framing. When rotating axle wheelsets are used, the value of yaw stiffness required to control the truck hunting must be relatively high. In some applications where the yaw stiffness is provided by the shearing action of load carrying pads, it is often desirable to limit the yaw forces by means of sliding surfaces employing material having a carefully selected friction characteristic. An alternative method for providing a high stiffness for small motions and a lower stiffness for large motions is the use of non-linear springs, particularly between the two axles Another means for providing the required yaw stiffness is a longitudinal member interconnecting one axle, the truck framing and the vehicle body in such a way as to create yaw moments which restrain deviations from a radial position in curves and from the parallel position on straight track. This longitudinal member, called a tow bar, can provide other desirable characteristics as described later.

The term "lateral" stiffness is defined as the restraint of one wheelset of a pair relative to the other in the direction paralleling the general axis of rotation. In the apparatus of the invention, the lateral stiffness acts to restrain parallelogramming of the wheelsets, and this stiffness is provided in part by the stiffness of the steering arms and in part by the stiffness of the elastomeric coupling means between the two arms.

Two major objectives of this invention are to prevent hunting and to improve the curving of trucks equipped with conventional self-steering rotating axle wheelsets, in part by applying lateral stiffnesses directly between the axles through the use of steering arms and in part by providing carefully chosen yaw stiffnesses of the axles relative to the truck framing and the car body.

In addition, I have discovered that similar means can be used to provide axle steering for rail vehicles having wheelsets in which the two wheels on each axle are free to rotate independently.

To achieve these general purposes, and with particular reference to railway trucks, the invention provides an articulated truck so constructed that: (a) steering arms directly interconnect pairs of axles to provide for exchanging steering moments between the two axles without involving the main truck framing; (b) carefully chosen values of yaw stiffness are provided relative to the truck framing and the other axles which tend to return the axles to a parallel position; (c) supplementary values of yaw stiffness may be provided between the truck and the vehicle where needed; and (d) non-linear values of yaw stiffness may be provided between the steering arms.

A retrofit embodiment of the invention applied to an existing conventional truck using conventional rotating axle wheelsets has been tested successfully at more than 90 miles per hour with virtually no trace of instability. This is in contrast with conventional trucks which are usually unstable at speeds above 45 miles per hour. A group of cars equipped with this embodiment has been found to roll as easily in a 4° curve as on straight track. This is in contrast to trains on conventional trucks which begin showing additional rolling resistance in curves sharper than 1°. In addition, the rolling resistance of conventional trucks in sharp curves is several times larger than the rolling resistance of cars retrofitted with the apparatus of this invention.

An embodiment consisting of a new truck with steering arms and tow bar steering was tested utilizing independently rotatable wheels. The tendency to truck hunting was found to be completely eliminated. Quiet curving was achieved in a curve of less than 50 foot radius with almost no increase in rolling resistance. Another embodiment having independently rotatable wheels and employing steering arms with carefully chosen yaw stiffnesses between the truck framing and the car body was found to give similar results.

In many of the tow bar arrangements, the tow bar elements handle longitudinal forces between the car body and the steering arms or sub-trucks, thereby taking care of forces arising, for example from coupling impacts, propulsion and braking.

The invention further contemplates the use of the tow bar linkage to provide steering for rotatable axle wheelsets and increase the high speed stability of conventional rotating axle wheelsets.

One embodiment uses two tow bars laterally displaced from the vehicle centerline which share longitudinal restraint of the truck framing and steering arms relative to the vehicle, one of said tow bars acting as a steering linkage, pivotally exchanging lateral steering forces among one steering arm, the truck framing and the car body. This construction is utilized to avoid mechanical interferences with other essential truck parts.

To more fully describe the stabilizing influence of the tow bar steering feature of the invention, it is necessary to consider the deviations of vehicle speed from the "Balance Speed" which is defined as that speed on a banked curved track at which there is no net lateral force relative to the track. It is a general practice to bank railroad track so that the Balance Speed is close to the normal operating speed. Above the Balance Speed, there is an outward net centrifugal force. Below the Balance Speed, there is a net force toward the center of the curve. It is important to understand that nearly all rail vehicles have some form of lateral suspension flexibility which permits some variation in the lateral position of the car body relative to the center of the track in the direction of the net lateral force. It is also important to recall that the net lateral forces due to curvature and speed are usually small compared to the lateral wheel/-rail forces generated by wheelsets whose axles are not in a radial position.

One the objects of the tow bar apparatus is to modify the yaw position of the wheelsets in response to lateral motion of the car body relative to the wheelsets in such a direction as to enhance stability and safety. This modification is analogous to the understeer characteristic built into highway vehicles for the same purpose.

On tangent track, the effect of a lateral wind gust is to cause the wheels to more easily move toward the lee rail. This will prevent cross wind forces from creating lateral instability of the wheelsets and car body. Experimental evidence collected from certain earlier steerable axle truck designs which attempted to utilize centrifugal forces to cause the car to steer into curves and also caused the wheelsets to steering into the wind were found to be relatively unstable on tangent track.

When operating in curves, the tow bar apparatus of the invention will urge the wheelsets toward the outer rail when the vehicle is running above the Balance Speed and toward the inner rail when running below the Balance Speed. This relationship may at first seem counterintuitive. But wheel climbing derailments do not occur when vehicles operate above the Balance Speed. Above the Balance Speed, the vertical force on the outer rail also increases, preventing the flange climbing tendency that might be expected. On the other hand, derailments frequently occur when operating below the Balance Speed. This is due to the fact that, with conventional trucks, there is always a large outward flange force on the outer rail, but below the Balance Speed the vertical load on the outer rail is reduced, and flange climbing is therefore made easier. With the tow bar feature of the invention, the wheelset is steered toward the inner rail where the vertical load is also increased, and flange climbing cannot occur.

My invention also provides improved lateral brake shoe guiding which will virtually eliminate contact of the brake shoes with the wheel flanges. The uneven wear of wheel flanges associated with conventional brake beam support methods tends to cause a wheel diameter mismatch in conventional rotating axle wheelsets and this shortens wheel life. The invention also contemplates improvements to the support of the brake shoe when handling braking forces. This improvement will compensate for the wheel unloading associated with the longitudinal braking force created between the vehicle and the track, lessening the tendency for generating flat wheels.

Added embodiments of my invention provide four-point suspension of the car body in conjunction with steering arms and have the objective of improving car body stability in a manner which avoids wheel unloading, truck frame parallelogramming and which reduces lateral wheel/rail forces. In addition, the swing hanger embodiment of my invention has the objective of the lateral springing of other embodiments of my invention in a truck having conventional side frames, outboard bearings and spring groups.

BRIEF DESCRIPTION OF THE DRAWINGS

In the drawings, certain aspects of the invention are shown schematically in FIGS. 1–4. In addition, eight structural embodiments representative of my invention are illustrated. A first appears in FIGS. 5–12; a second in FIGS. 13–15; a third in FIGS. 16–22; a fourth in FIGS. 23–25; a fifth in FIGS. 29A–33; a sixth in FIGS. 37–40; a seventh in FIGS. 34–36; and an eighth in FIGS. 41–44. Each of these eight embodiments utilizes various of the principles and features taught in more general terms in FIGS. 1–4, and the third and fourth embodiments are particularly concerned with the retrofitted trucks as mentioned above. The drawings also include three figures (26–28) showing the AAR truck. These figures are labelled "Prior Art" and will assist in understanding the simple yet effective way in which the invention may be applied to such a truck, while utilizing most of the truck parts with a minimum of modification. With further general reference to the drawings, the individual figures and the various groups and embodiments mentioned above are identified as follows:

FORCE AND MOTION DIAGRAMS

Figure 1:
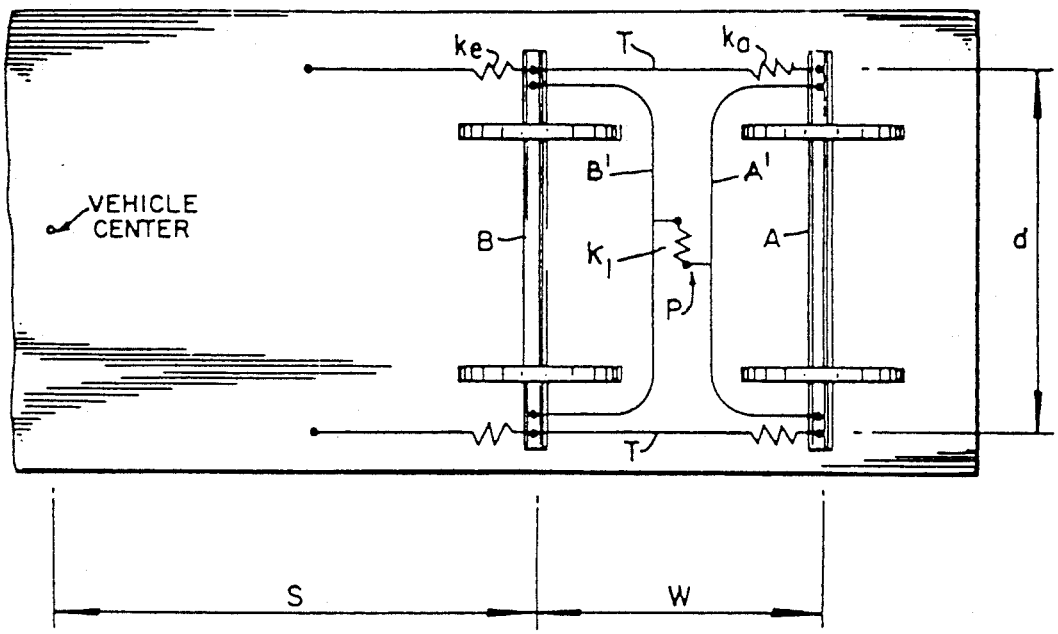
Figure 2:
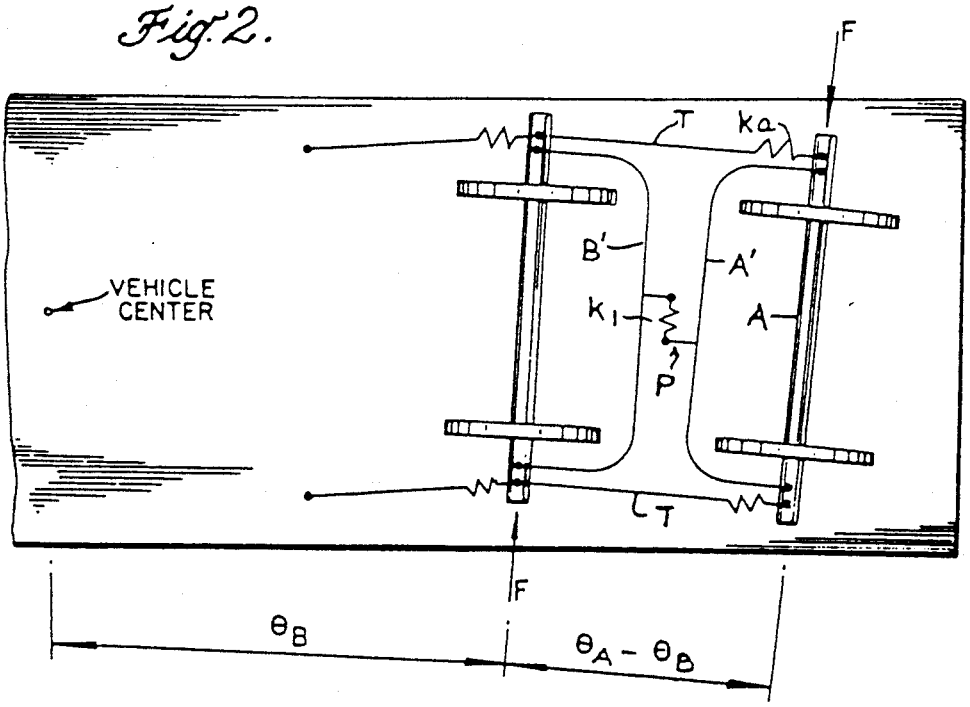
Figure 3:
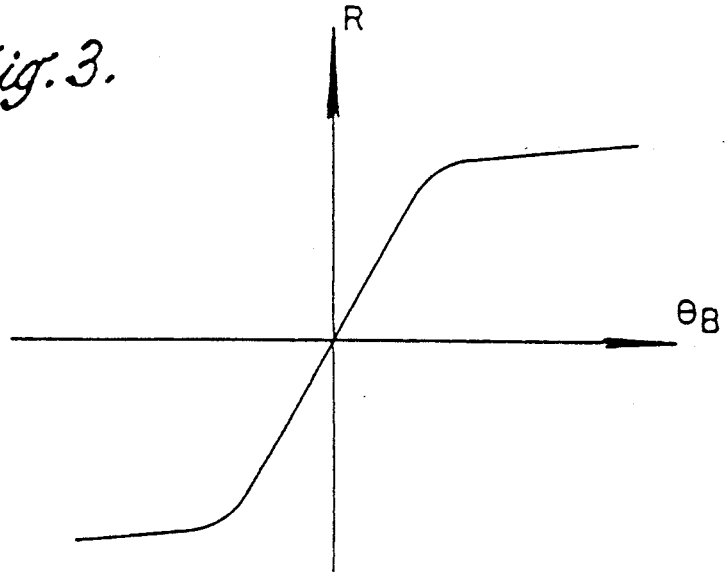
Figure 4:
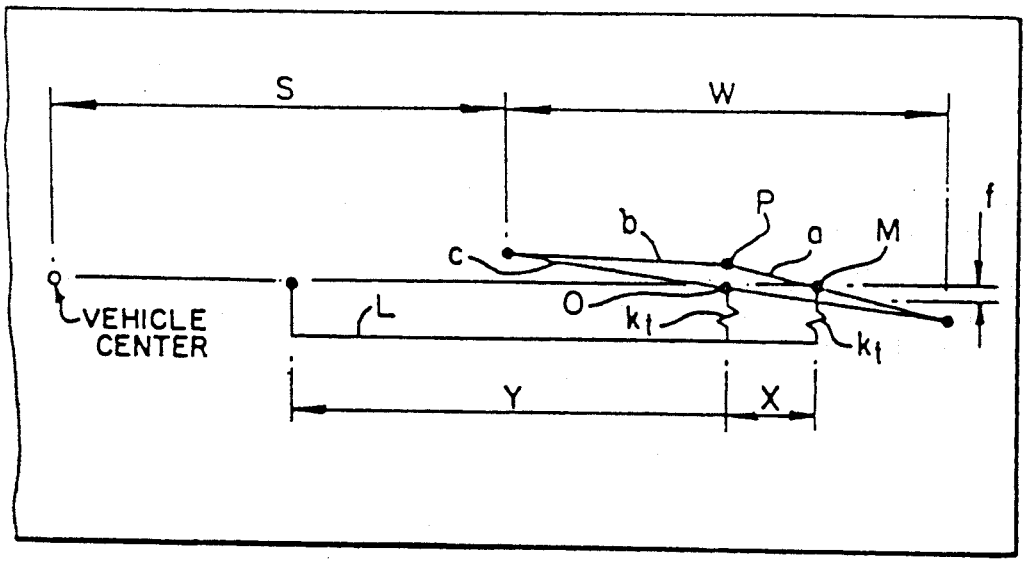
Figure 5:
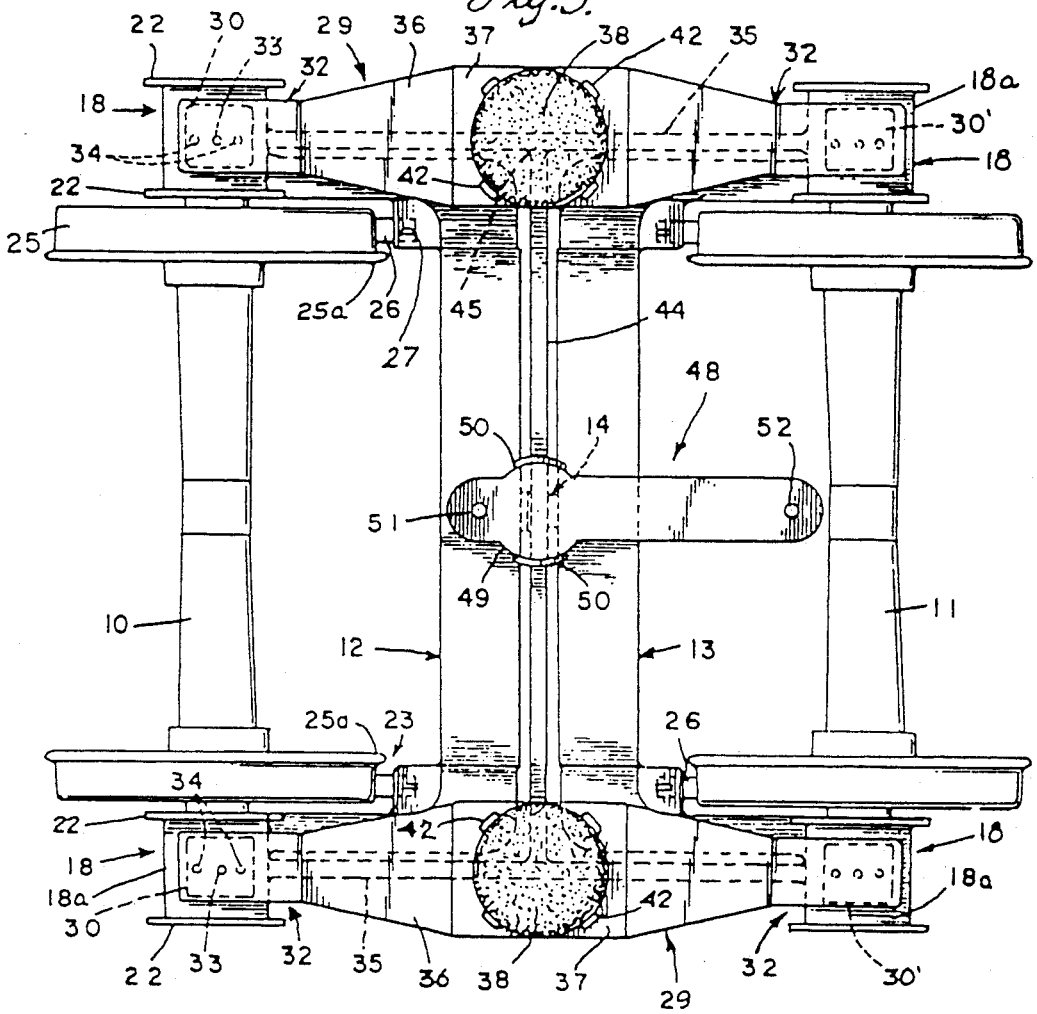

FIG. 1 is a schematic showing of the invention, and illustrating a railway vehicle having truck means which include a pair of wheelsets coupled and damped in accordance with principles of the invention;

FIG. 2 shows schematically, and in basic terms, the response of such a truck to a curve;

FIG. 3 shows a plot of the longitudinal force between the truck side frames and the vehicle, using modified restraining means under conditions of very sharp curving, the reaction being plotted against the angle of track curvature;

FIG. 4 is a diagrammatic sketch of a truck is generally similar to that shown in FIG. 5 and including a steering link or tow bar;

FIRST EMBODIMENT

Figure 6:
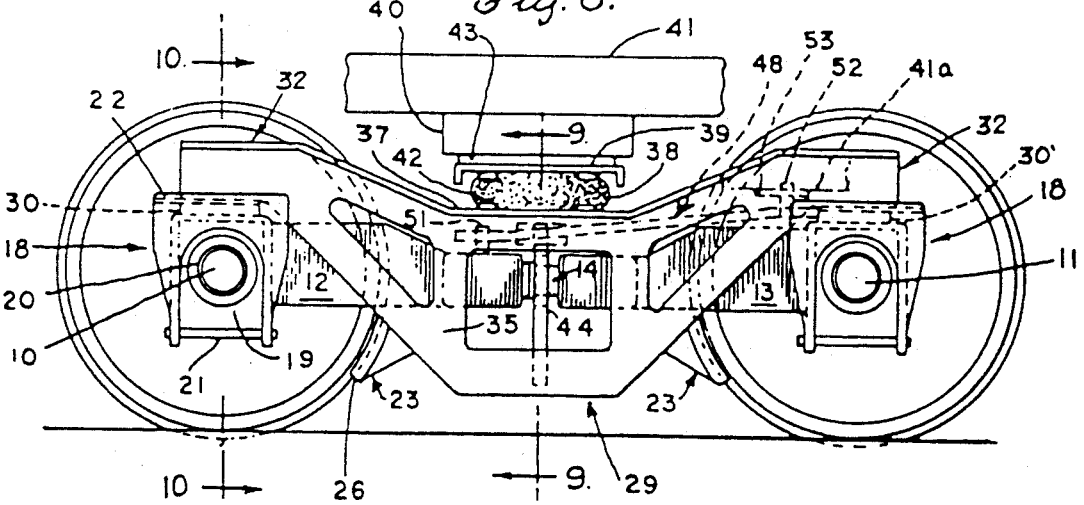
Figure 7:
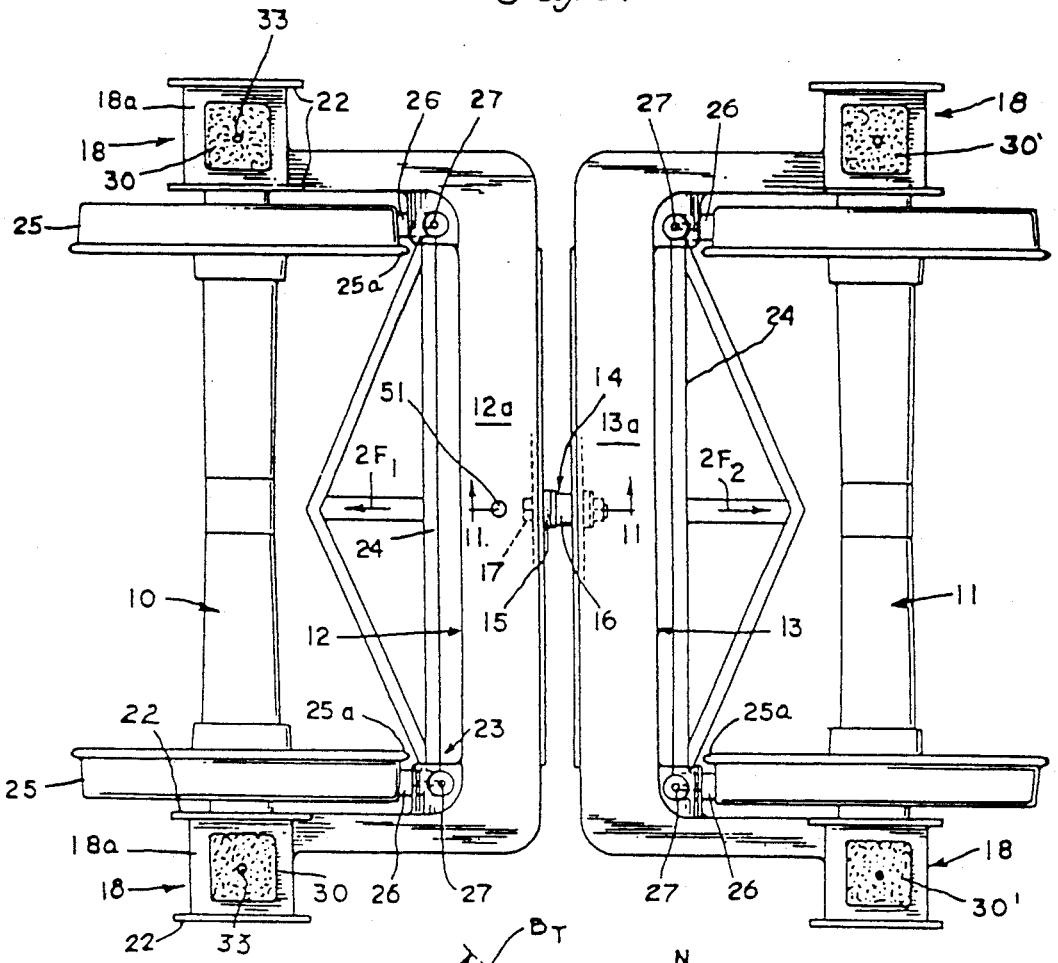
Figure 8A:
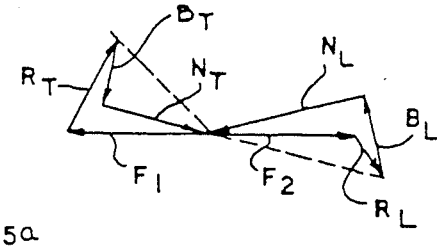
Figure 8:
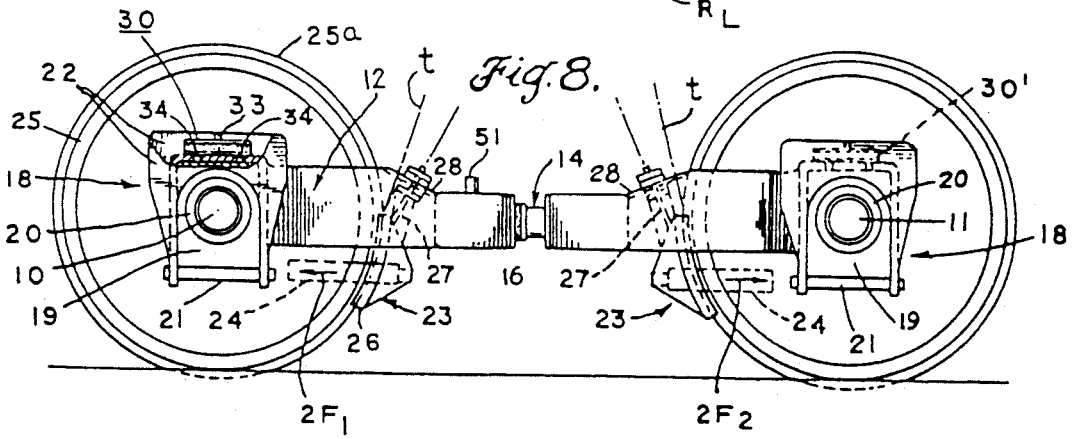

FIG. 5 is a plan view of the first structural embodiment referred to above and shows a railway truck constructed in accordance with the invention, and embodying principles illustrated schematically in FIGS. 1 and 4;

FIG. 6 is a side elevational view of the apparatus shown in FIG. 5;

FIG. 7 is a plan view of the railway truck of FIGS. 5 and 6 with certain upper parts omitted, in order to more clearly show the steering arms, their central connection and features of brake rigging;

FIG. 8 is a side elevational view of the apparatus shown in FIG. 7;

FIG. 8*a* is a force polygon illustrating the functioning of the brakes;

FIG. 9 is a cross-sectional view taken on the line 9—9 of FIG. 6;

FIG. 10 is an enlarged cross-sectional view of the journal box structure taken on the line 10—10 of FIG. 6;

FIG. 11 is an enlarged sectional view of the central connection of the steering arms taken on the line 11—11 of FIG. 7;

FIG. 12 is a cross section taken on the line 12—12 of FIG. 11;

SECOND EMBODIMENT

FIG. 13 is a plan view illustrating the second structural embodiment of a railway truck, and uses side frame and bolster castings somewhat similar to those used in conventional freight car trucks;

FIG. 14 is a side elevational view of the apparatus of FIG. 13;

FIG. 15 is an enlarged sectional plan view of the central connection device of the steering arms of the truck of FIGS. 13 and 14;

THIRD EMBODIMENT

Figure 16:
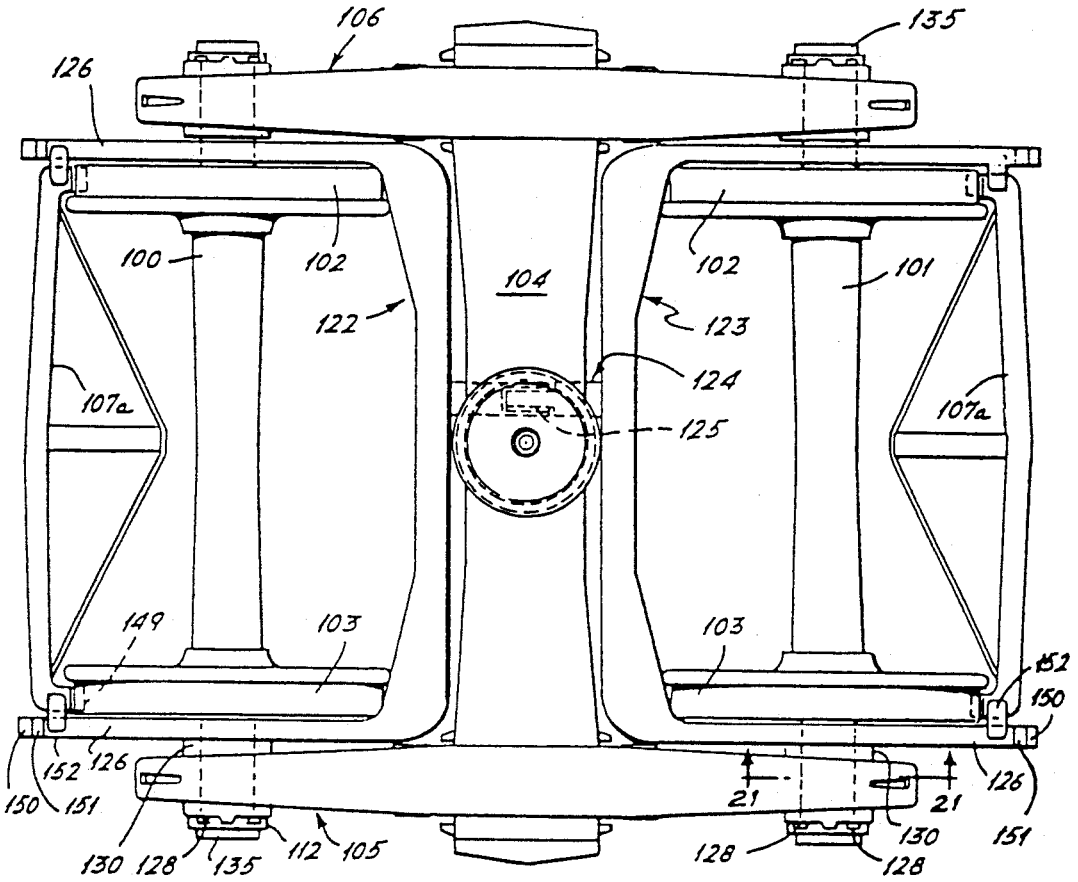
Figure 17:
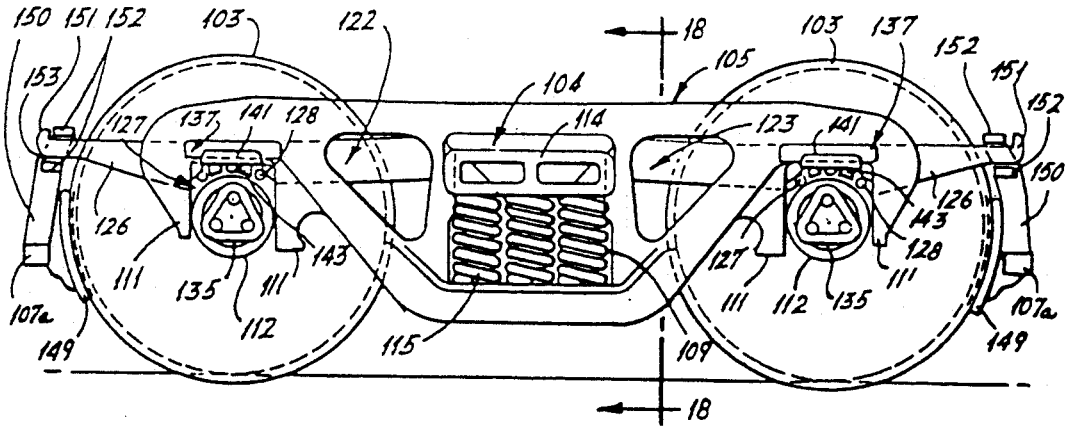

FIGS. 16, 17 and 18 are, respectively, plan side and sectional views of the mentioned third structural embodiment of the invention;

FIGS. 19–22 are views showing details of the apparatus appearing in FIGS. 16–18, on a larger scale, two of these detail views being in perspective;

FOURTH EMBODIMENT

FIGS. 23 and 24 are, respectively, partial plan and side views of the apparatus of the fourth embodiment, and FIG. 25 is a perspective showing of a part of that apparatus;

PRIOR ART AAR TRUCK

Figure 26:
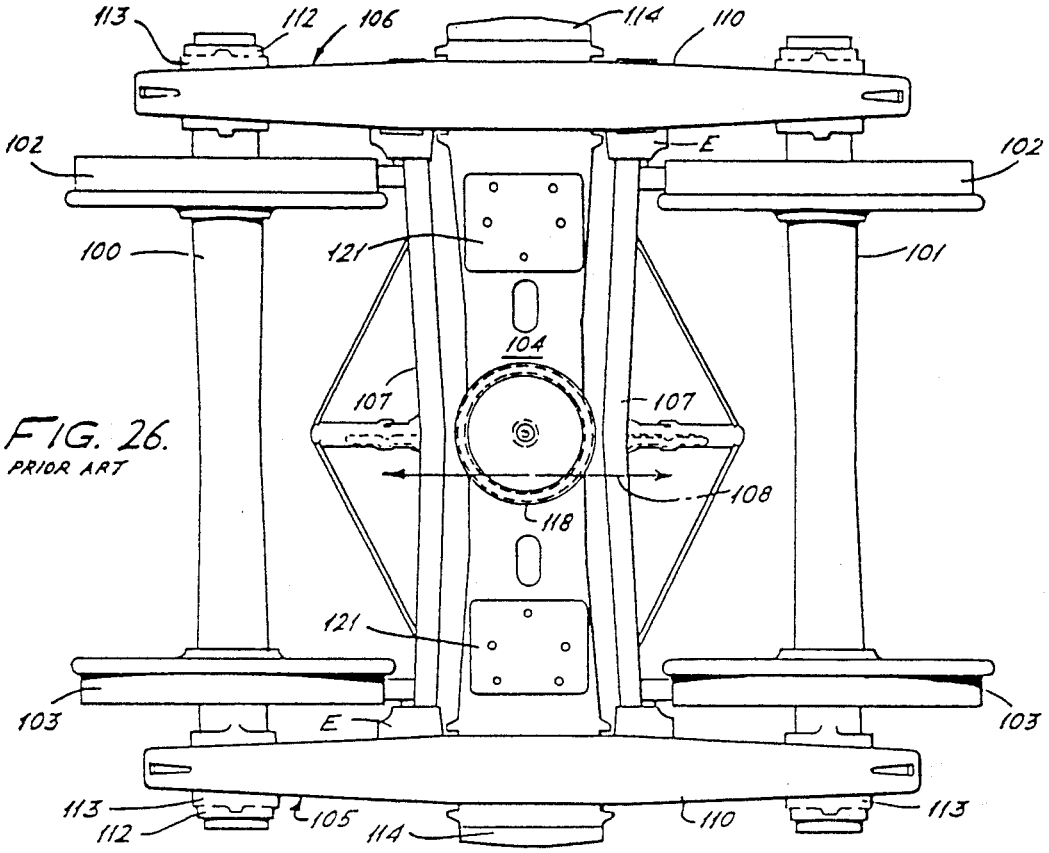
FIG. 26. PRIOR ART

FIGS. 26,, 27 and 28 show the prior art truck prior to the retrofitting as shown for example in FIGS. 16 to 22;

FIRST EMBODIMENT STEERING ACTION

Figure 5A:
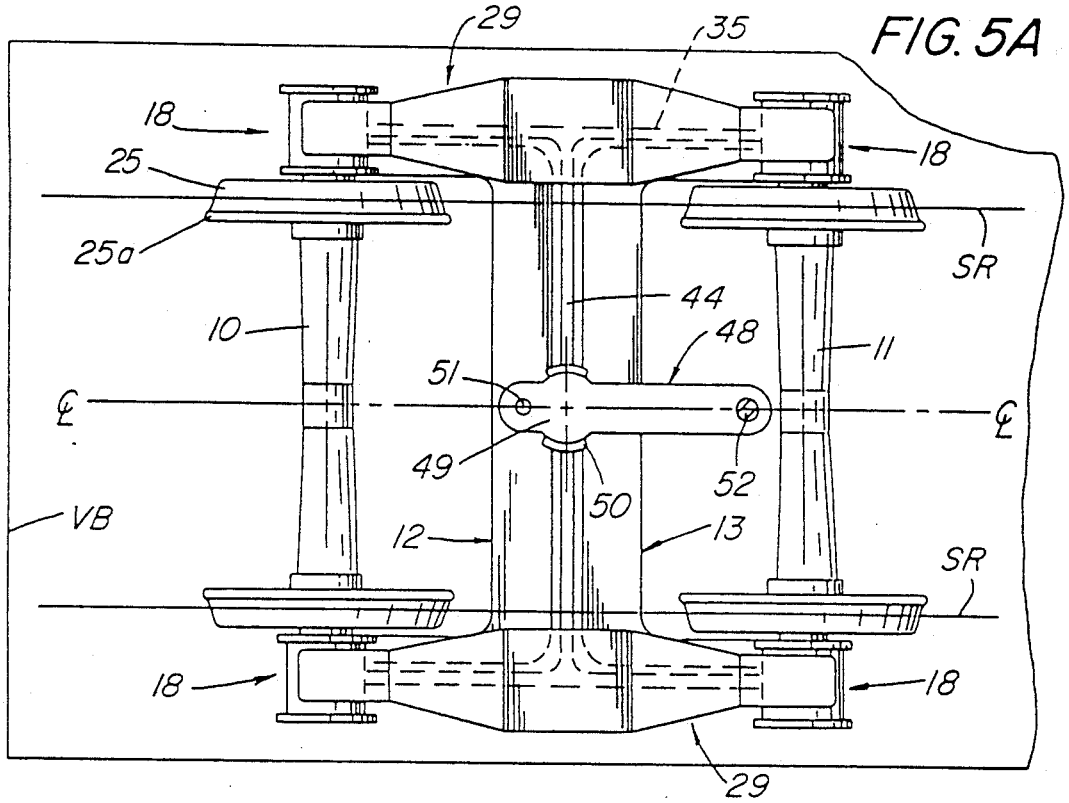
Figure 5B:
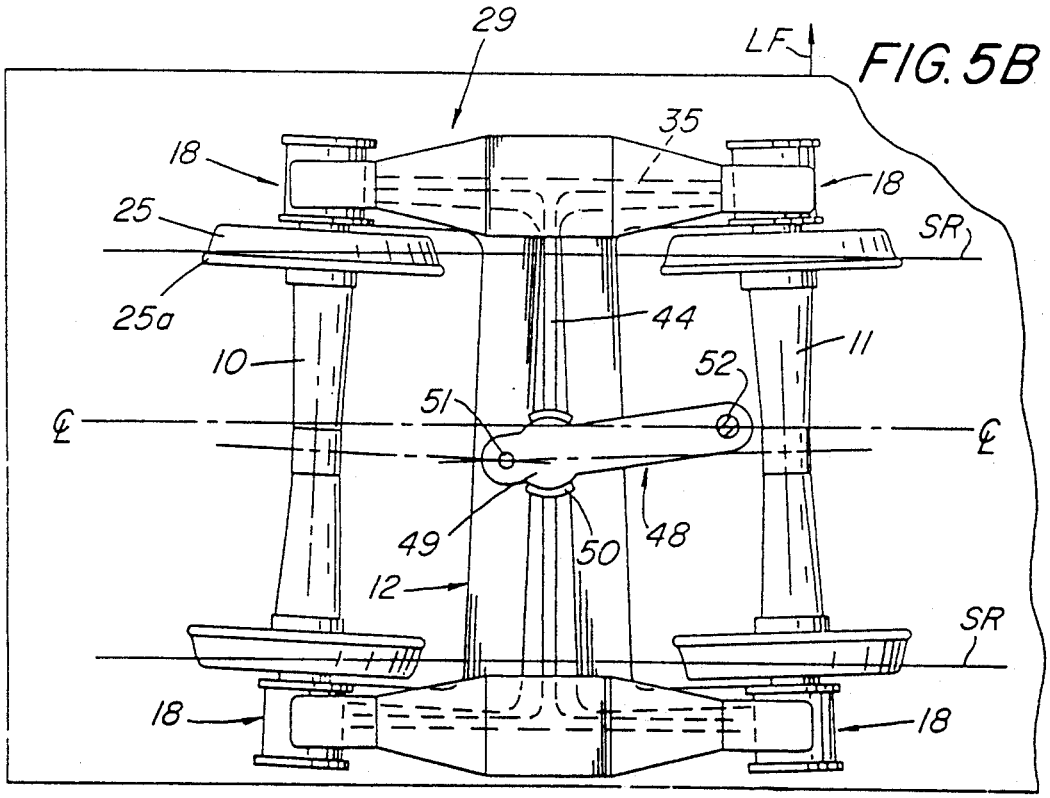
Figure 5C:
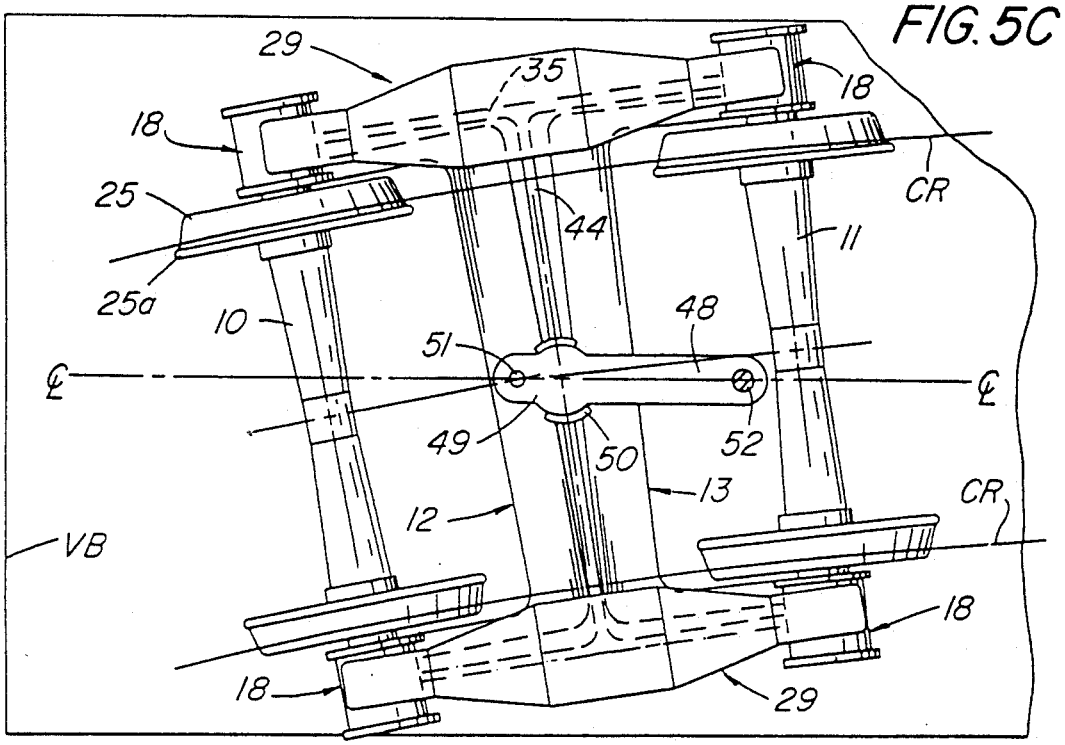
Figure 5D:
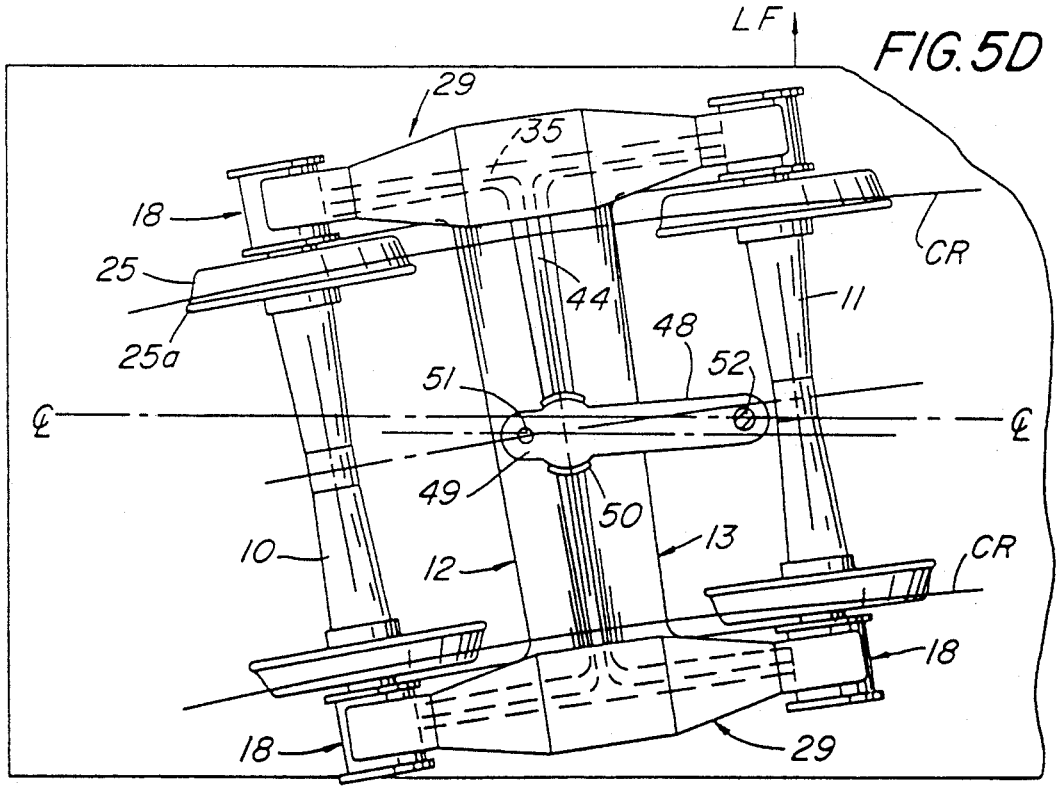
Figure 5E:
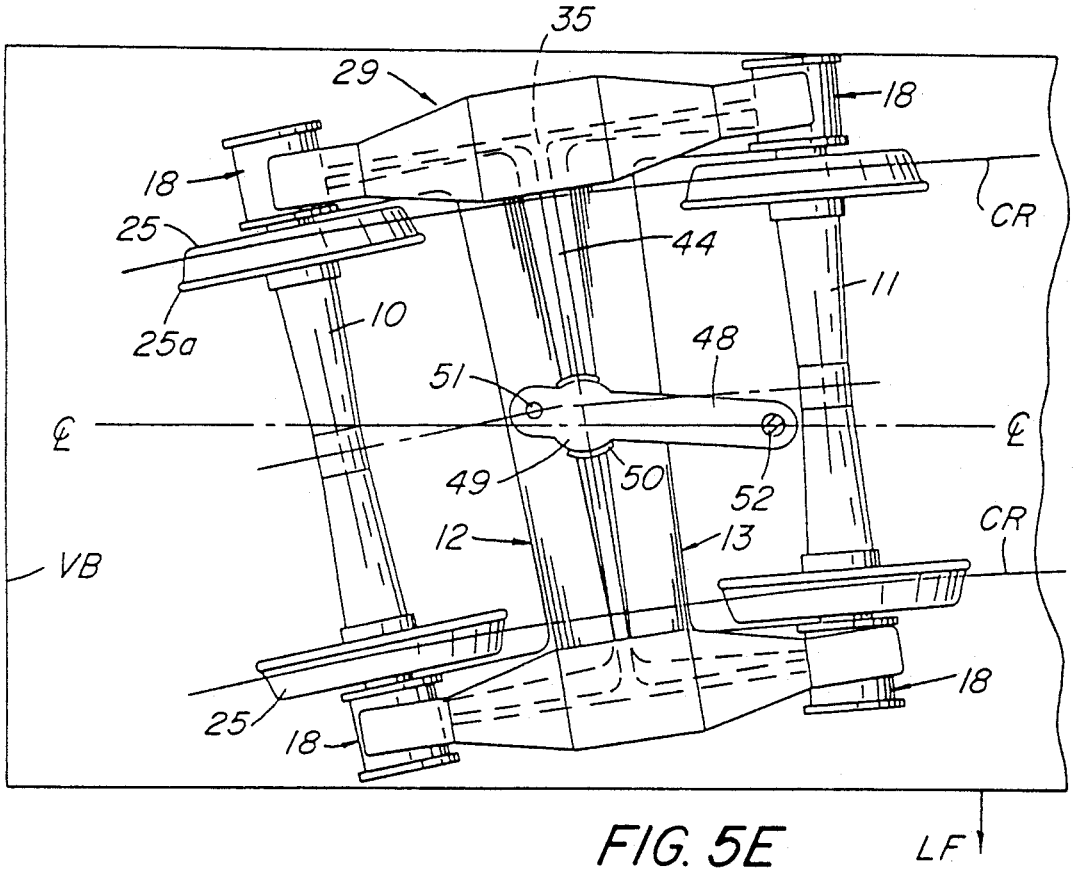

FIGS. 5A and 5B illustrate steering action of first embodiment on a straight rail path with the car body centered and displaced laterally;

FIGS. 5C, 5D and 5E illustrate steering action of first embodiment on curved rail path, FIG. 5C being typical of operation at the Balance Speed, 5D being above the Balance Speed and 5E being below;

FIFTH EMBODIMENT AND ITS STEERING ACTION

Figure 29A:
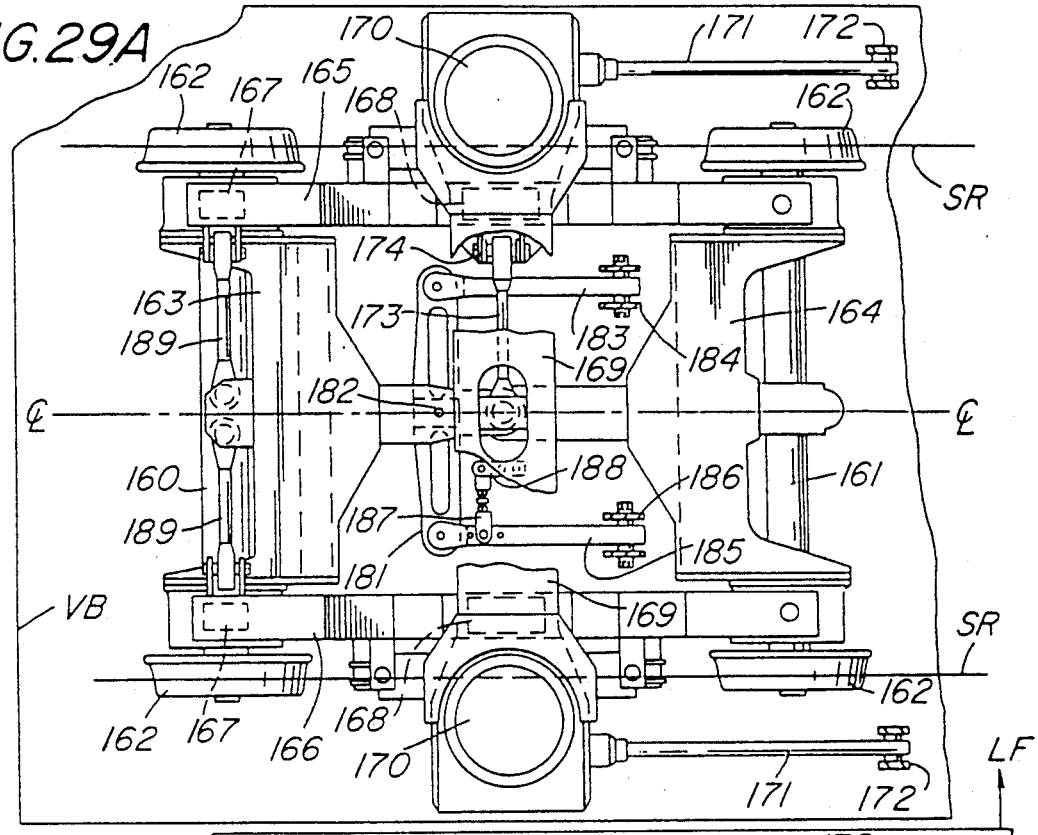
Figure 29B:
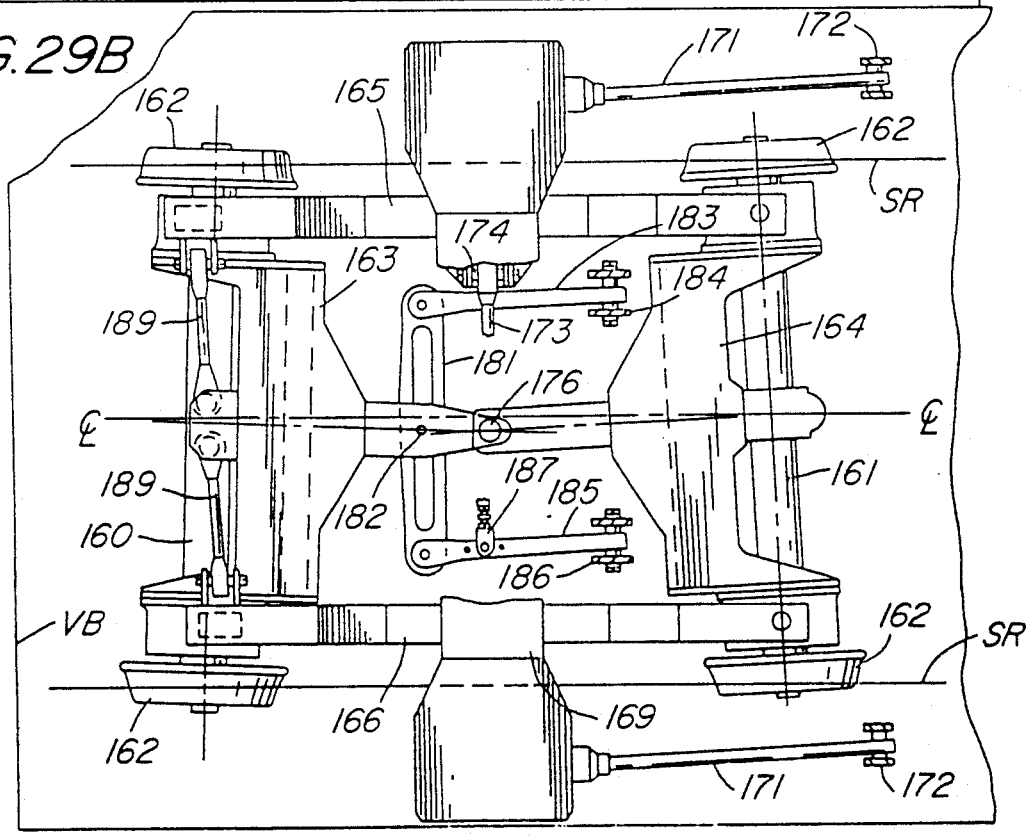
Figure 29C:
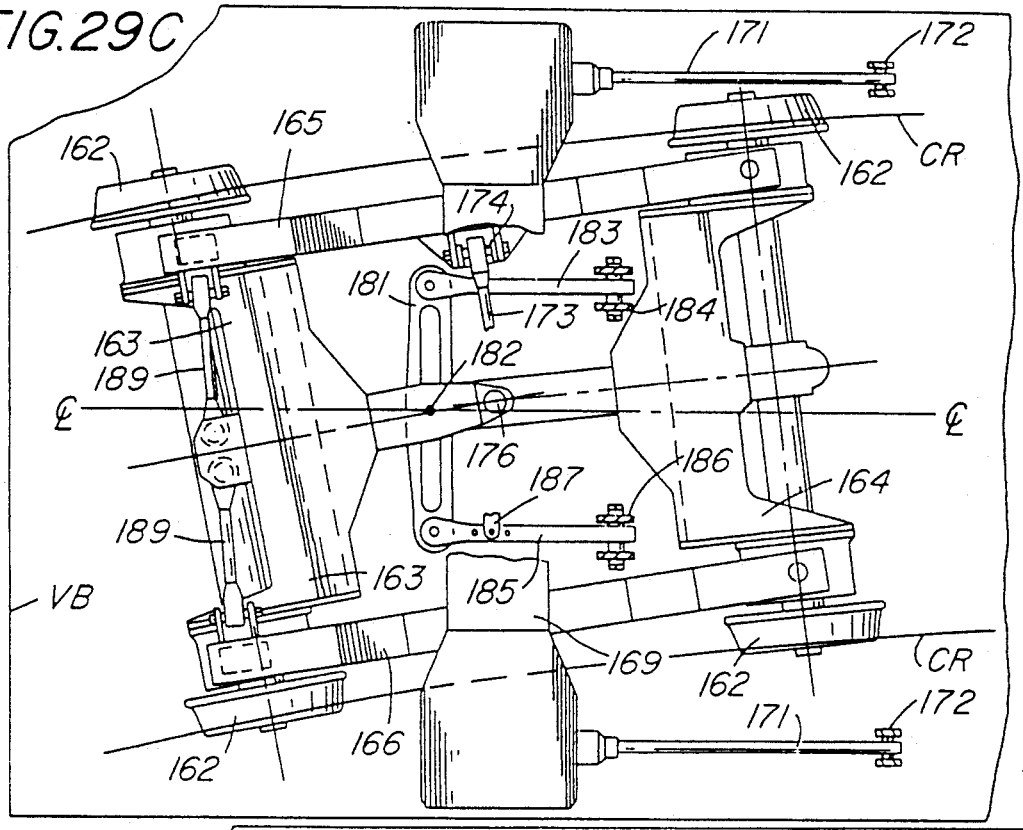
Figure 29D:
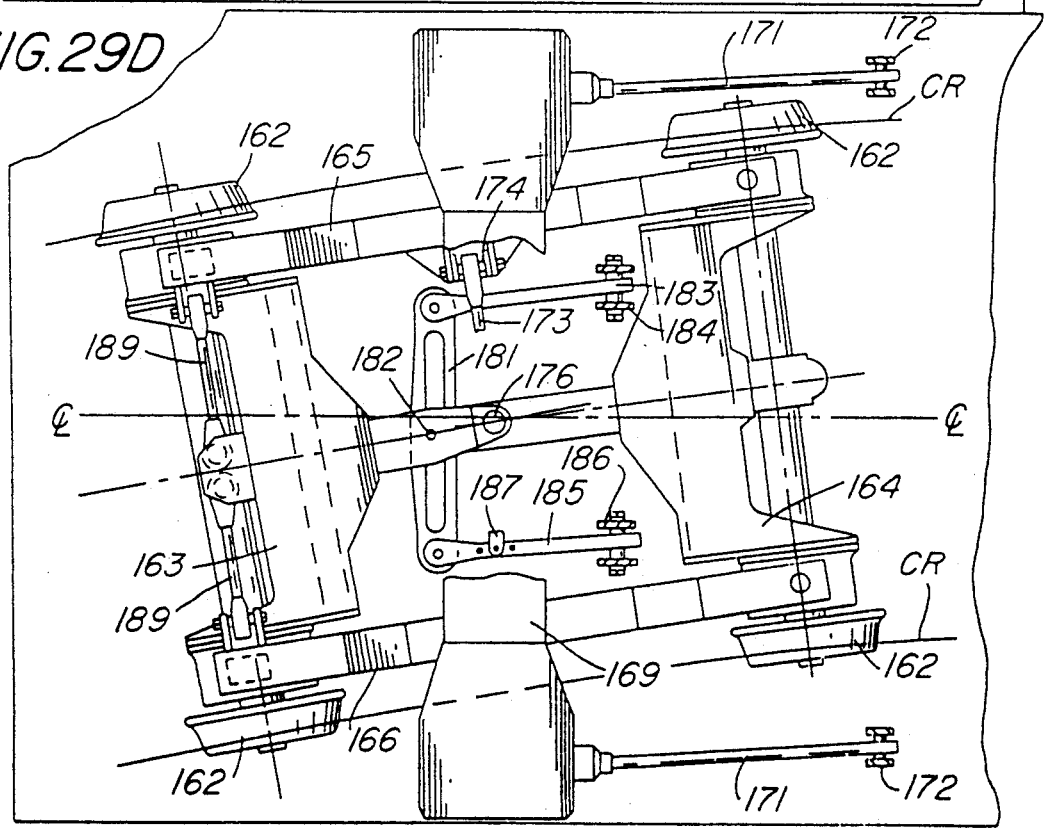
Figure 30:
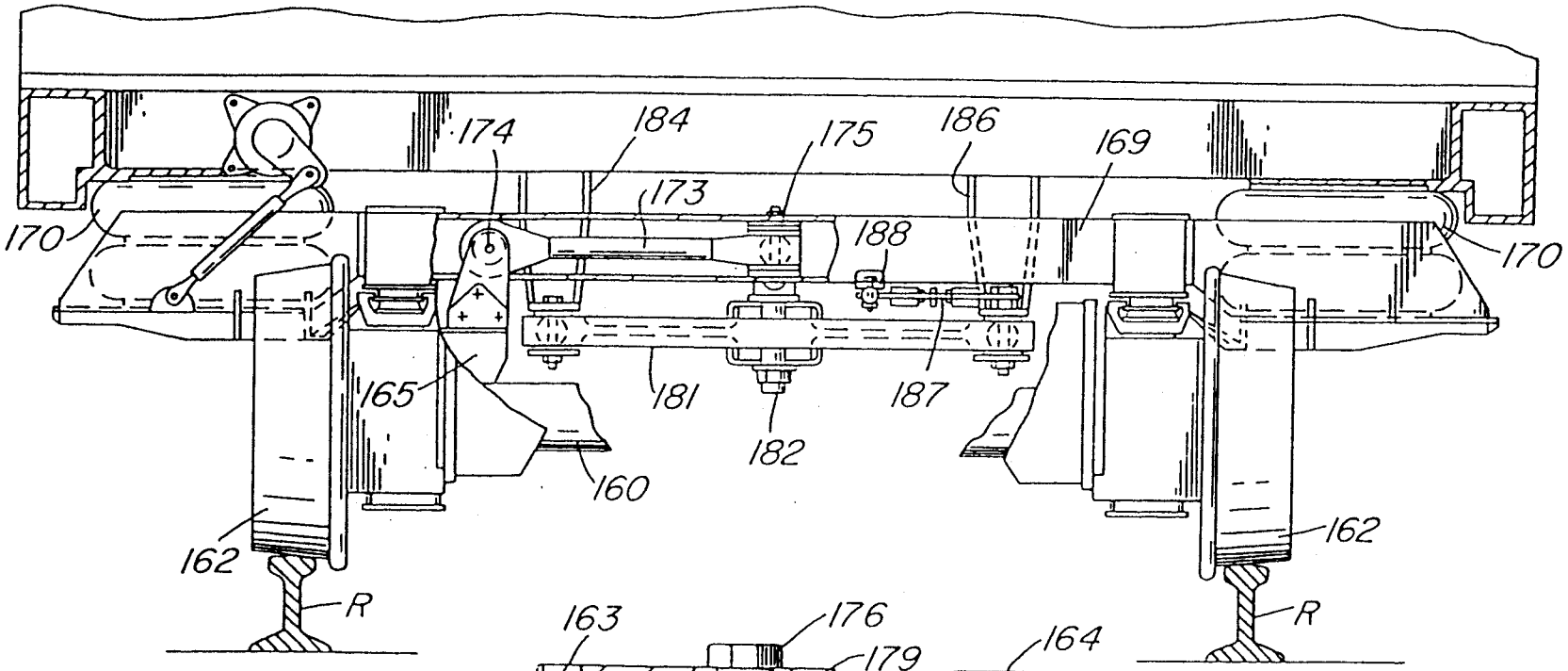
Figure 31:
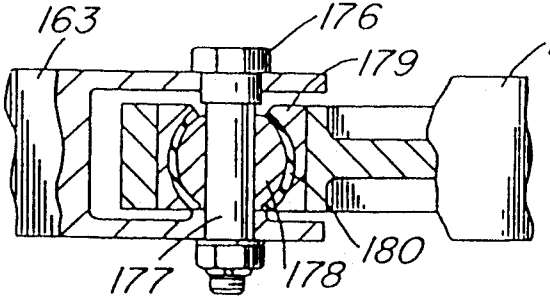
Figure 32:
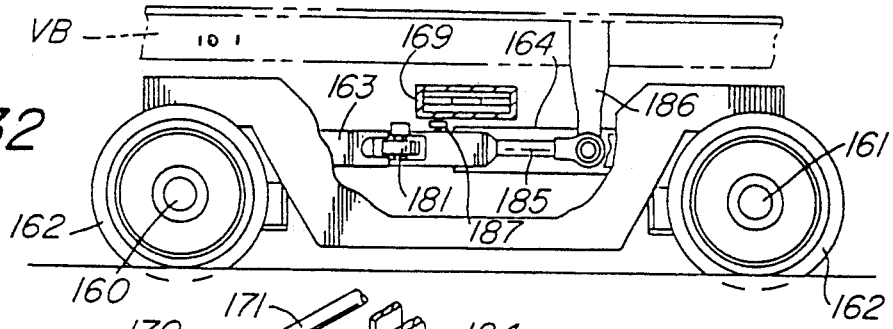
Figure 33:
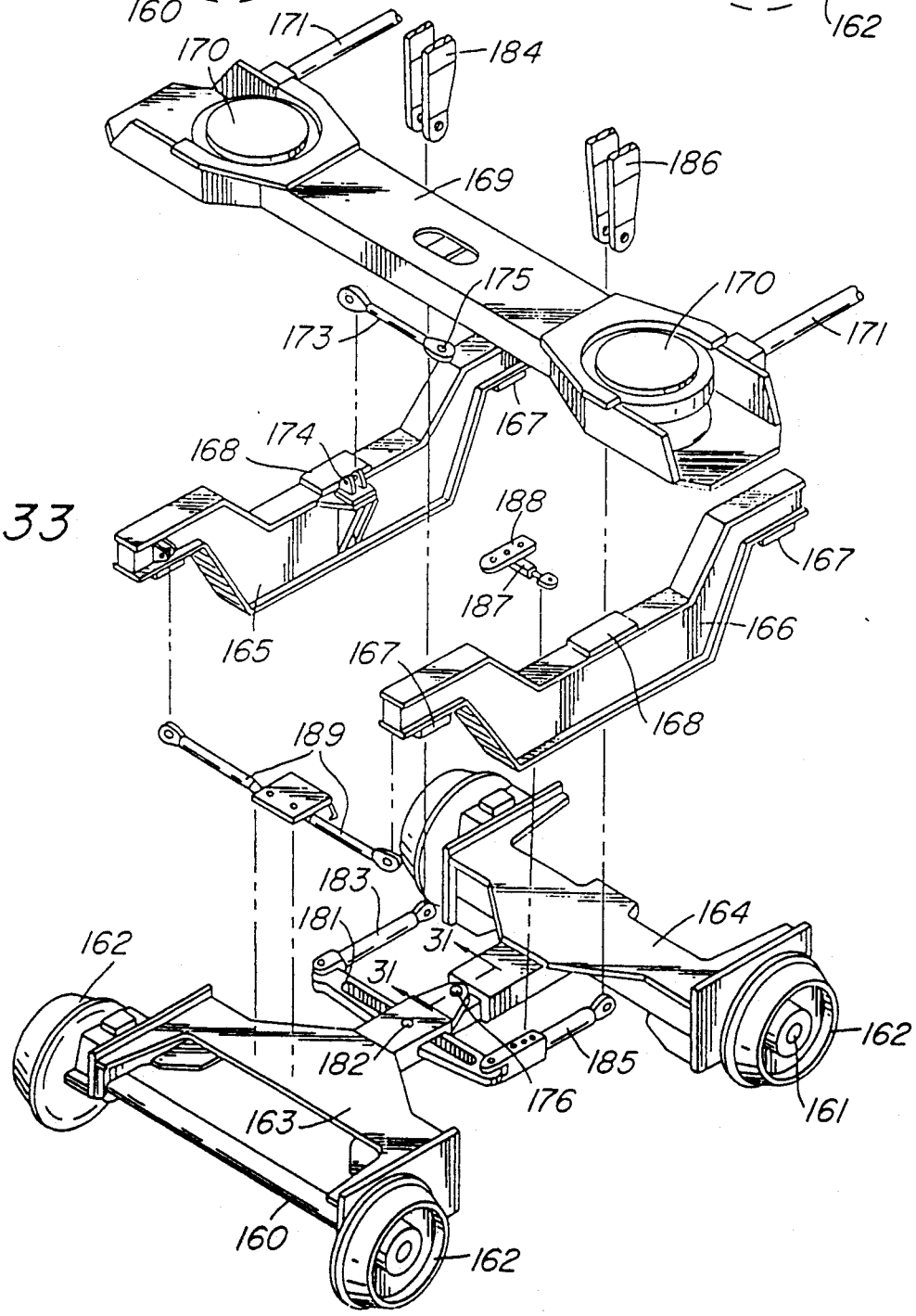

FIG. 29A is a plan view of the truck of the fifth embodiment, the truck here being shown in relation to a straight rail path;

FIG. 29B is a similar somewhat simplified plan view of the truck of FIG. 29A but illustrating a steering function on a straight track when there is lateral displacement of the car body due to forces such as a lateral wind load;

FIG. 29C illustrates the position of the truck of 29A at Balance Speed in a curve. FIGS. 29D and 29E are views somewhat similar to FIG. 29B but illustrating the steering function of the truck of FIG. 29A on a curved rail path;

FIG. 29D being a position typical of operation above the Balance Speed;

FIG. 29E being typical of operation below the Balance Speed;

FIG. 30 is an enlarged end view of the truck of FIGS. 29A to 29D;

FIG. 31 is an enlarged detailed view of the joint between the steering arms;

FIG. 32 is a side view of the truck of FIGS. 29A, 29D and 30 with parts of the truck side frame broken out;

FIG. 33 is a vertically exploded isometric view of the principal parts of the truck of FIGS. 29A to 29D and 30 and 31;

SIXTH EMBODIMENT

Figure 37:
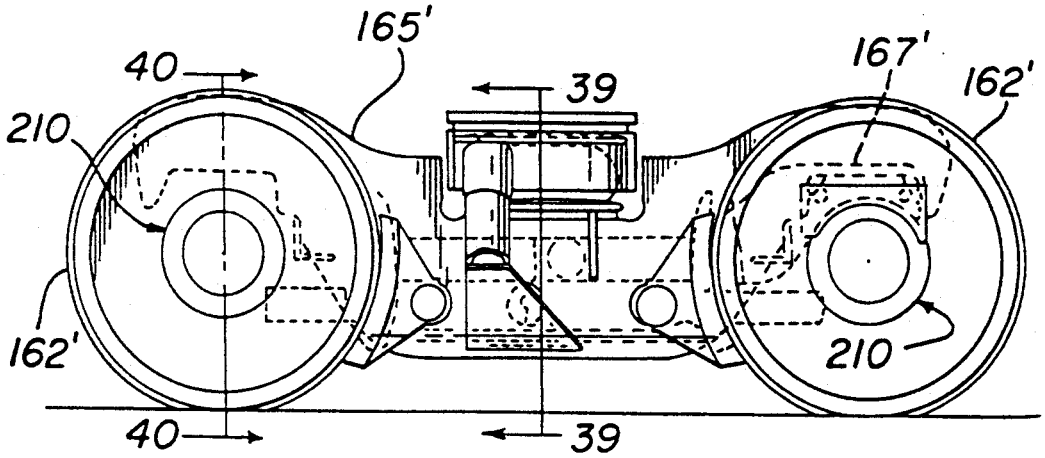
Figure 38:
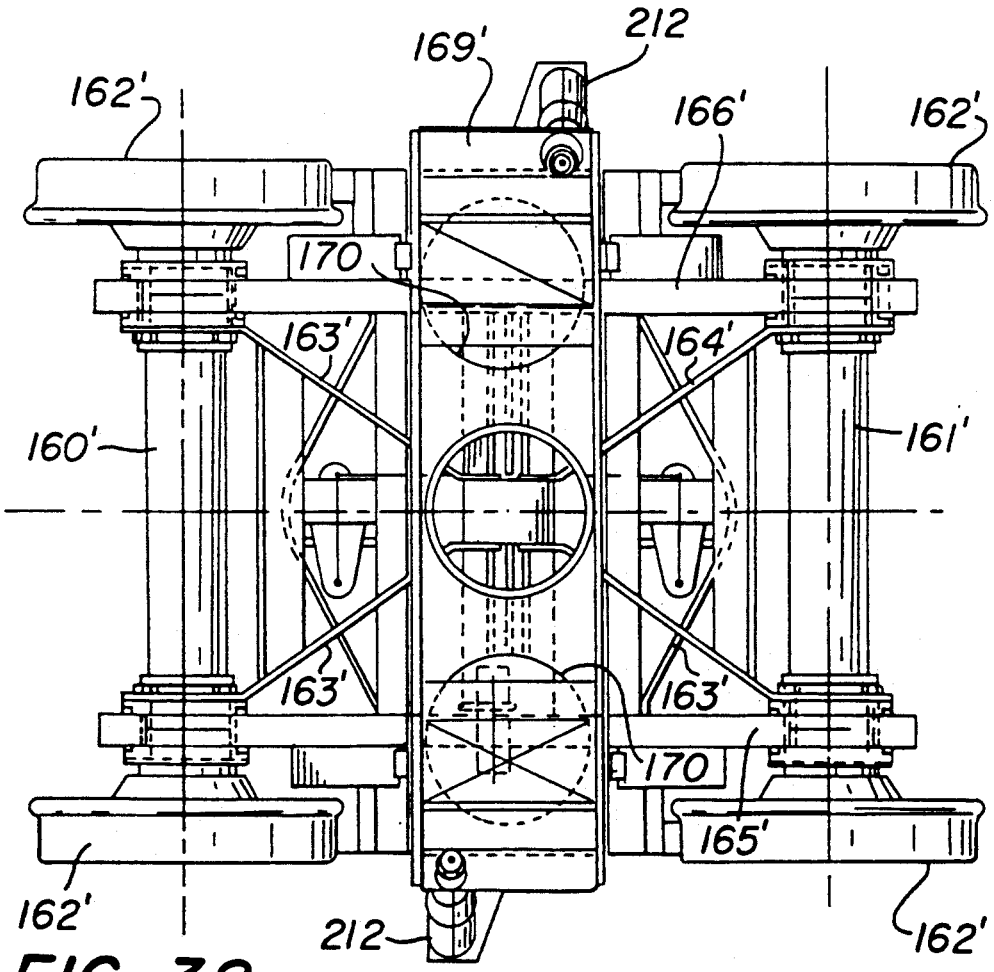
Figure 39:
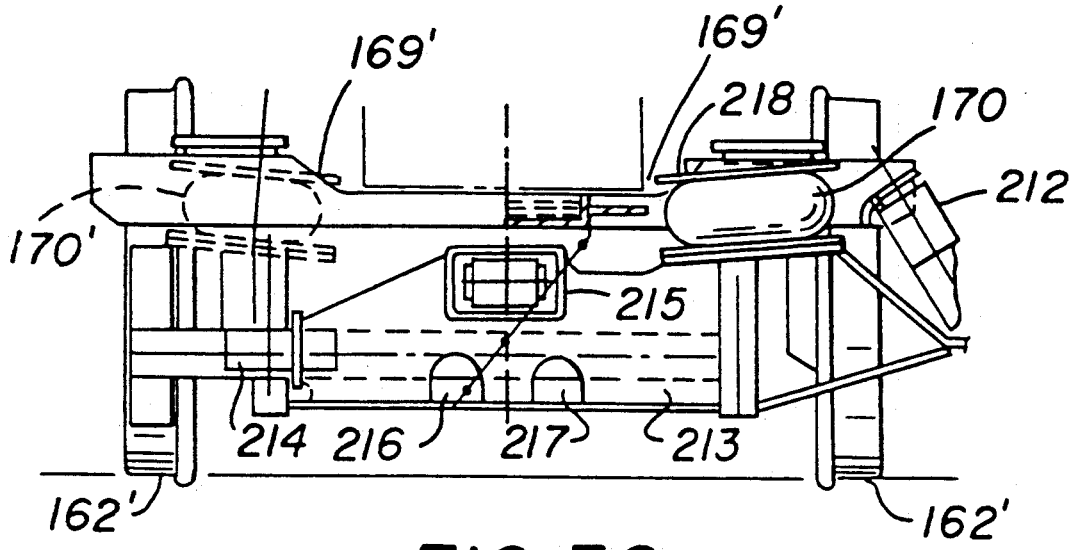
Figure 40:
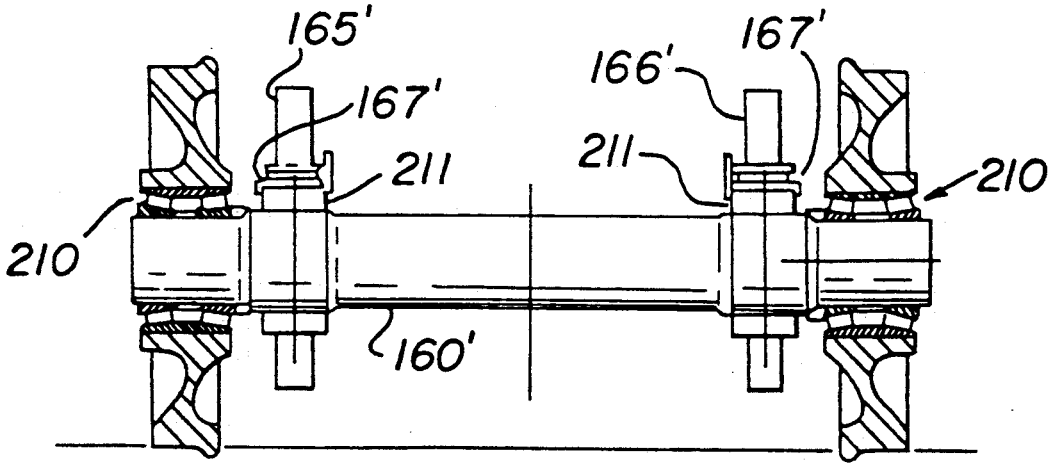

FIG. 37 is an elevational view of the truck of the sixth embodiment of the invention;

FIG. 38 is a plan view of the truck of FIG. 37;

FIG. 39 is a sectional view taken along line 39—39 with portions removed for clarity of illustration;

FIG. 40 is a sectional view taken along line 40—40 of FIG. 37;

SEVENTH EMBODIMENT

FIG. 34 is a plan view of certain control devices adapted for use with various forms of steering arms, such as those of the several embodiments referred to above;

FIG. 35 is a sectional of one of the control devices of FIG. 34; and

FIG. 36 is a force diagram illustrating the action of the devices shown in FIGS. 34 and 35.

EIGHTH and NINTH EMBODIMENTS

Figure 43:
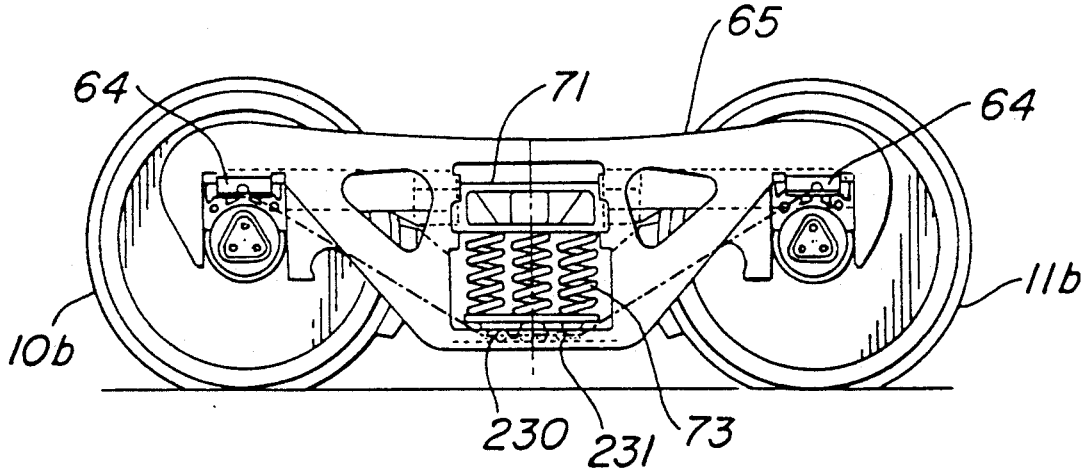
Figure 44:
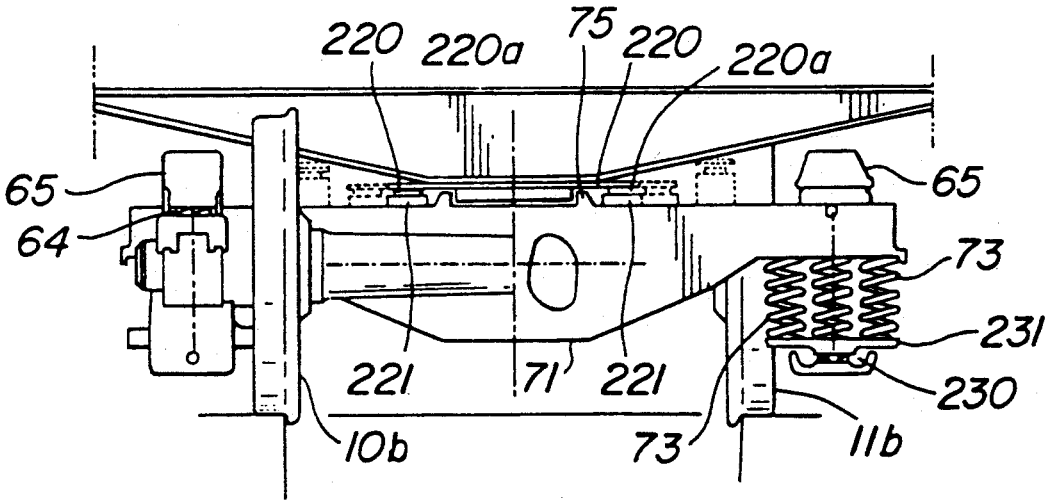

FIGS. 41 and 42 illustrate a truck of the construction of FIGS. 13–15 illustrating a modified form of railway car support; and FIGS. 43 and 44 illustrate further modifications to the truck of FIGS. 13–15 in which lateral flexibility is introduced by modification of the side frames.

DETAILED DESCRIPTION

FORCE AND MOTION DIAGRAMS

The steering action of a four-wheel railroad car truck constructed according to the invention is illustrated somewhat schematically in FIGS. 1 and 2. The embodiment for use under the trailing end of a highway vehicle would be virtually identical, but, for simplicity, railroad truck terminology is used in the description.

The essential parameters are as follows:

The yaw (longitudinal) stiffness between the "inside" axle "B" and the truck side frames "T" is very high, i.e., a pinned connection.

The yaw stiffness between the "end" axle "A" and the truck side frames "T" is $k_a$.

The yaw stiffness between the truck side frames "T" and the vehicle is $k_e$.

The side frames "T" are essentially independent, being free to align themselves over the bearings (not illustrated) of axles "A" and "B" even when there is substantial deflection in the longitudinal direction of the resilient member $k_a$.

Lateral forces between the two axles are exchanged at point "P" located in the mid-region between a pair of subtrucks, or steering arms, A' and B'. This interconnection has a lateral stiffness of $k_l$ and may also make a contribution to the yaw stiffness between the two axles. This connection provides for balancing of steering moments between the two axles as well as providing the lateral stiffness.

The basic response of such a truck to a curve is shown in FIG. 2. The elastic restraints $k_a$ and $k_e$ have been deflected by lateral forces "F". The forces "F" can arise either from flange contact or from steering moments caused by creep forces between the wheels and the rails. Experimentally, it has been observed that, for relatively low values of $k_a$ and $k_e$, the axles will tend to assume a radial position in curves for a large range of variation of the ratio $k_a/k_e$. I have further discovered that for higher values, the proper value for this ratio must be chosen as a function of the truck wheelbase "w" and the distance "s" from axle "B" to the vehicle center. Thus a means is provided to have the high value for yaw stiffness needed for high speed stability while simultaneously providing radial positioning of the axles in sharp curves. The basic mathematical relationships which assure radial positioning of the axles are as follows:

For the axles to be in a radial position, their angular displacement will be proportioned to their distance from the center of the car body;

$$O_A - O_b = c \times w \text{ and } O_b = c \times s.$$

where c=the curvature per foot of length along the curve.

This gives the following ratio between the angles and the distances.

$$\frac{O_A - O_B}{O_B} = \frac{w}{s}$$

The angles are also dependent on the yaw stiffness.

$$O_A - O_B = \frac{F \times w/2}{k_a \times d} \text{ and } O_B = \frac{F \times w}{k_e \times d}$$

Substituting, we find that the relationship between the yaw stiffness and the distance should be:

$$k_e = k_a \times \frac{2w}{s} \text{ or } \frac{k_a}{k_e} = \frac{s}{2w}$$

Given the proportionality $k_a/k_e = s/2w$ it is a simple matter to translate the values for elastic restraint into suitable components. In the design and testing of one of the truck embodiments described below, the value for $k_a$ was selected to obtain stability against hunting up to a car speed of one hundred miles per hour. With this component established, use of the proportionality considered above readily yields the value to be embodied in the other elastomeric restraints, which are disposed between the car body and side frame ($k_e$).

In the case of rail vehicles where there is only a small clearance between the wheel flanges and the rail, the above ratio should be closely maintained. When conventional rotating axle wheelsets are used, the action of the forces arising from the self-steering moments will correct for some error, and the curving behavior will be superior to a conventional truck, even if it is not perfect.

When independently rotatable wheels are used, greater care should be taken to provide the correct stiffness ratios because the wheelsets themselves have no self-steering properties. On the other hand, much lower overall stiffness values may be used giving correspondingly lower forces in the associated truck parts.

In the case of highway vehicles, when a low value of $k_a$ can also be chosen, the rear bogie will tend to follow the front end of the vehicle rather precisely in a curve. As $k_a$ is increased above the theoretical value used for a rail application, the trailing end of the vehicle will track inside the front end. If $k_a$ is made very stiff, the bogie will approach, but will always be superior to, the tracking characteristics of a conventional bogie. As will be understood in all cases given, $k_a$, $k_e$ can be calculated.

The apparatus shown schematically in FIGS. 1 and 2 will provide the desired major improvement in curving behavior and high speed stability with rotating axle wheelsets on all ordinary railroad curves. However, there is a need to limit the flange force and the forces within the truck framing which occur when operating on the very sharp curves in many transit systems. This is most easily done by using non-linear elastic restraints as shown in FIG. 3.

This restraint is comprised of a steep linear center section and end sections where the value is much less. This will limit the reaction forces within the truck framing, which will in turn limit the flange force "F".

For certain applications such as rail rapid transit vehicles where curves are sharp and the yaw angles of the axles and truck are large, it will be found desirable to add the feature shown in FIG. 4. The addition of steering link, or tow bar, "L" provides a means to keep the yaw stiffness high as desirable with rotating axle wheelsets without contributing significantly to the flange force in curves. The presence of the restraints $k_l$ make it possible to choose low values for $k_a$ and $k_e$ without sacrificing yaw stiffness between the vehicle and the running-gear and within the running-gear.

The following parameters are dealt with in consideration of FIG. 4:

s=distance from vehicle center to closest axle;
w=truck wheelbase, axle-to-axle;
b=centerline of subtruck (steering arm) associated with axle B;
a=centerline of subtruck (steering arm) associated with axle A;
c=centerline of truck framing;
O=center (pivot point) of truck framing;
P=point of interconnection of the subtrucks;
L=tow bar (steering link). In FIG. 4 it is shown offset from the vehicle centerline better to show $k_l$;
M=the point of interconnection between the tow bar and subtruck a;

x = the distance between the truck center 0 and the interconnection at M;

$k_l$ = the lateral flexibility which limits the ability of the steering link to keep the lateral position of M the same as the lateral position of P; [When certain prototype trucks were operated in the FIG. 4 configuration, $k_l$ was the lateral stiffness of pads used to provide $k_a$ between the side frames and the sub-trucks].

y = the distance between the connection of the steering link to the truck framing at M, and the point of connection of the link to the vehicle; and f = the distance between the truck centerline and point M at the distance x from the truck center. This dimension is used in deriving the computation of the proper dimension for x.

The optimum values for x and $k_l$ must be found by experiment. However, it can be shown that x should be larger than a specific minimum at which the axles would assume a radial position if the restraints $k_l$ were infinitely rigid. This minimum value can be calculated using the equation $x_{min} = w^2/4(s+w)$. This value is based on the fact that the angle between "b" (L to axle B, FIGS. 1 and 2) and the vehicle centerline, and the angle between "a" (L to axle A, FIGS. 1 and 2) and the vehicle centerline are proportional to the distances from the center of the vehicle (s and s+w). The lateral distance "f" in FIG. 4 can be calculated two ways, i.e.:

$$f = \frac{1}{r}(2s - w)x \text{ and:} \quad (1)$$

$$f = \frac{1}{r}\left(\frac{w}{2} - x\right)w \text{ where } \frac{1}{r} \text{ is the track curvature.} \quad (2)$$

Equating these two expressions;

$$2sx - wx = \left(\frac{w}{2} - x\right)w$$

Solving for x gives;

$$x = \frac{w^2}{4(s + w)}$$

With rotating axle wheelsets, the optimum value for $k_l$ will depend primarily on the total value for yaw stiffness required for high speed stability, the percentage of that value supplied by $k_a$ and $k_e$ and the percentage of that value contributed by the rotational stiffness of the connection at P. The value $k_l$ can be chosen to make up the remainder required. With wheelsets employing wheels which can rotate relative to each other, much lower stiffness value may be used because, with no torque in the axle, there are no steering moments created by tangential wheel/rail forces.

There is also the question of choosing a proper value for y. This should be chosen as long as practical if it is desired to minimize coupling between the lateral motion of the vehicle which respect to the running-gear and the steering motions of the axles. However, the length y has been made as short as two-thirds w in prototypes where tests have shown substantial coupling between lateral motion of the car body and the steering action of the truck helps to stabilize lateral motions of the car body.

The principles disclosed above can be used directly to design running-gear having an even number of axles by grouping them in pairs. These principles have also been used to design a three-axle bogie, not shown.

The principles considered above have been applied in the design and construction of a number of railway freight and transit car trucks and are applicable as well to locomotive trucks.

Figure 27:
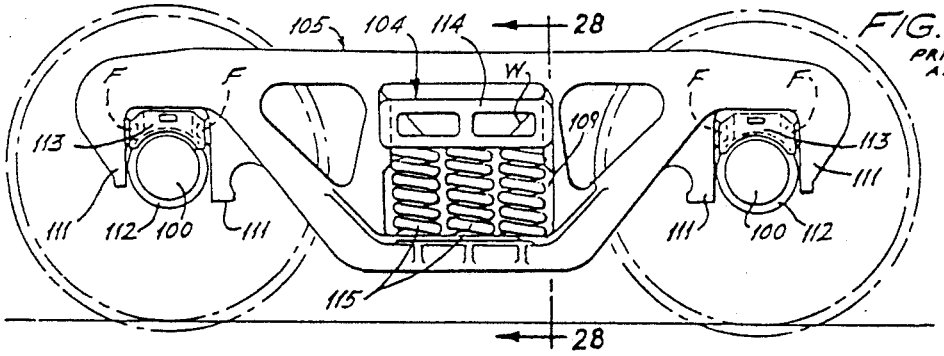
FIG. 27. PRIOR ART
Figure 28:
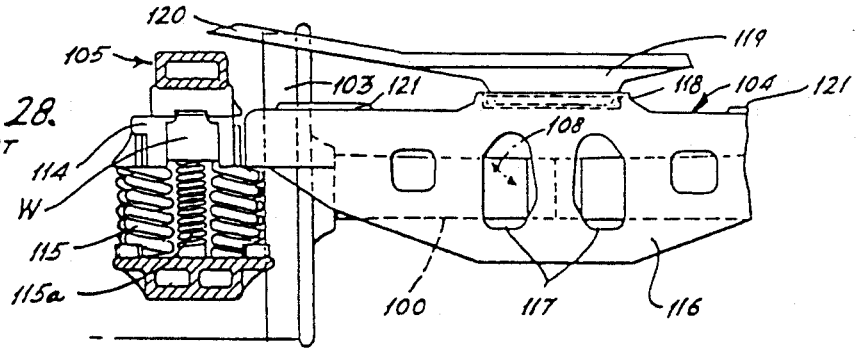
FIG. 28. PRIOR ART

Six truck embodiments are shown in the drawings. One appears in FIGS. 5–12, another in FIGS. 13–15, the third in FIGS. 16–22, the fourth in FIGS. 23–25, the fifth in FIGS. 29a–33 and the sixth in FIGS. 37–40. The embodiments in FIGS. 16–22 and FIGS. 23–25 are suitable as "retrofit" arrangements for conventional freight car trucks and will be considered in comparison with the prior freight car art, as illustrated in FIGS. 26–28.

FIRST EMBODIMENT

With detailed reference, initially, to FIGS. 7 and 8, from which parts have been omitted more clearly to show the manner in which each of two axles 10 and 11 is rigidly supported by its subframe (termed a "steering arm" in the following description), it will be seen that each axle is carried by its steering arm 12 and 13, respectively, and that each axle has a substantially fixed angularity with respect to its steering arm in the general plane of the pair of axles. The steering arms are generally C-shaped, as viewed in plan (c.f. the steering arms A′ and B′ of FIGS. 1 and 2), and each has a portion extending from its associated axle to a common region (12a, 13a) substantially midway between the two axles. Means bearing the general designation 14, to which more detailed reference is made below, couples the steering arms 12 and 13 with freedom for relative pivotal movement and with predetermined stiffness against lateral motion in the general direction of axle extension. In this embodiment, the stiffness against lateral motion of one axle relative to the other in the direction of axle extension and in the plane of the axles (it corresponds to the resilient means $K_l$ shown diagrammatically at P in FIG. 1), takes the form of a tubular block 15 of any suitable elastomeric material, e.g., rubber. It is suitably bonded to a ferrule, or bushing 16 (see particularly FIGS. 11 and 12), which is provided as an extension of steering arm 13 and to a pin 17 which couples the steering arms, as is evident. This block or pad 15 through which the steering moments are exchanged has considerable lateral stiffness. The angular resilience is sufficient so that each axle is free to assume a position radial of a curved track, and lateral resilience is sufficient to allow a slight parallel yaw motion of rotating axle wheelsets. This acts to prevent flange contact on straight track when there are lateral loads such as strong cross winds.

Turning now to the manner in which axle is carried by its associated arm, it is seen that each steering arm carries, at each of its free ends, journal box structure 18 integral with the arm (see, for example, arm 12 in FIGS. 7 and 8). The box shape can readily be seen from the figures and opens downwardly to receive bearing adapter structure 19, of known type, which locates the bearing cartridge 20. Both ends of both axles 10 and 11 are mounted in this fashion, which does not require more detailed description herein. Retaining bolts 21 prevent the bearing 20 from falling out of the adapter 19 when the car truck is lifted by the truck framing.

Each journal box 18 has spaced flanges 22,22 which have portions extending upwardly and laterally of the journal box. These flanges define a pedestal opening which serves as retaining means for the car side frames, and also for novel pads interposed between the journal boxes and the side frames, as will presently be described. However, before proceeding with that description, and still with reference to FIGS. 7 and 8, it will be noted that each steering arm 12 and 13 carries a conventional brake beam assembly which is supported in a novel way. These assemblies are designated, generally, at 23 (FIG. 8) and each includes a braced brake beam 24 extending transversely between the wheels (e.g., the wheels 25,25 carried by axle 10), and each end of each beam carries a brake shoe 26 which is aligned with and disposed for contact with the confronting tread of the wheel. The mounting of the brake assemblies has significant advantages considered later in this description. For present purposes, it is sufficient to point out that the brake beams 24 are prevented from moving laterally toward and away from the flanges 25*a* of the wheels and, for this purpose, the opposite end portions of the beams are carried by rod-like hangers 27, each of which extends through and is secured in a sloped pad 28 provided in corner portions of each steering arm 12 and 13 (see particularly FIG. 8).

In particular accordance with my invention, and with reference to FIGS. 5 and 6, reference is now made to the manner in which the truck side frames 29,29 are carried by the steering arms, being supported upon elastomeric means which flexibly restrains conjoint yawing motions of the coupled pair of wheelsets, that is, provides restraint of the steering motions of the axles with respect to each other, and thus opposes departure of the subtrucks (the steering arms and their axles) from a position in which the wheelsets are parallel. As will not be understood from FIGS. 2 and 3 described above, this restraining means ($k_a$ in those figures) may be provided only at the ends of that axle which is more remote from the center of the vehicle. However, it is frequently desirable to provide such restraint at the ends of each axle; it can be of different value at each, depending upon the particular truck design.

As shown in FIGS. 5–8, the restraining means takes the form of elastomeric pads 30, preferably of rubber, supported upon the journal box between the flanges 22 and interposed between the upwardly presented flat surface 18*a* of each journal box 18 and the confronting lower surface 31 (FIG. 10) of the I-beam structure which comprises the outboard end portions 32 of each side frame 29. As indicated in FIGS. 7 and 8, and as shown to best advantage in FIG. 10, the pads 30 are sandwiched between thin steel plates 30*a*,30*a*, the upper of which carries a dowel 33 and the lower of which is provided with a pair of dowels 34. The upper and lower dowels are received within suitable apertures provided, respectively, within the surface 31 of side frame end portion 32 and the confronting surface 18*a* of journal box 18. The purpose of the dowels is to locate the elastomeric pads 30 with respect to the journal box and to position the side frame with respect to the pad 30. The side frame is thus supported upon the pads and between the flanges 22.

As shown in FIG. 6, each side frame 29 has a center portion which is lower (when viewed in side elevation) than its end portions 32. This center portion includes part of a web 35 having a top, laterally extending flange 36, which is narrower at is outer extremities (FIG. 5) which overlie the journal box 18 and provides the bearing surface 31 (FIG. 10). The flange 36 reaches its maximum width in a flat central section 37 which comprises a seat for supporting an elastomeric spring member 38. This member has the form, prior to imposition of the load, of a rubber sphere. Member 38, although not so shown in the drawings, may, if desired, be sandwiched between steel wear plates. Desirably, and as shown, means is provided for locating the member 38 with respect to the seat 37 of the side frame and, with respect to the overlying car bolster 39 (FIGS. 6 and 9), which, with sill 40, spans the width of the car and is secured thereto. The car is illustrated fragmentarily at 41 in FIG. 6. This locating means, as shown in FIGS. 5, 6 and 9, may conveniently take the form of lugs 42 integral with the support surface 37 and the confronting lower surface of car bolster 39. A bearing pad 43, which may be of Teflon or the like, is interposed between the upper surface of car bolster 39 and the overlying car sill structure 40 (FIGS. 6 and 9). This forms a sliding bearing surface which operates to place a limit on flange forces which might otherwise become excessive in very sharp curves.

As will now be understood, the resilience of the elastomeric sphere-like members 38 provides the restraint identified as $k_e$ in the description with reference to FIGS. 1 and 2. As stated, its value is determined in accordance with the proportionality $k_a/k_e=s/2w$. In one embodiment of the invention which yielded good results, sphere-like springs marketed by Lord Corporation of Erie, Pa., and identified by part number J-13597-1, were found suitable for applicant's special purposes described above.

The truck shown in FIGS. 5–8 can be made to function as does the truck of FIGS. 1 and 2 by either omitting pads 30' at axle 11 or by making these pads substantially stiffer than pads 30 at axle 10. The benefit achieved by doing this is that the steering effect, such as shown in FIG. 2, is obtained merely by the proper distribution of the stiffness of pads of the axles.

A support or cross-tie 44 extends between the webs 35 of the side frames 29 in the central portion of the latter (FIGS. 5 and 6) and has its ends fastened to the side frame web as shown at 45 in FIG. 9. The cross-tie is a relatively thin plate with its height extending vertically, and its center portion has an aperture 46 through which passes the means 14 which couples the mid-portions of the two steering arms 12 and 13. The aperture 46 is of larger diameter than the coupling means 14. As shown in FIG. 9 and as also appears in FIG. 6, it is important for the purposes of the invention that there be freedom for limited longitudinal motion of one side frame with respect to the other in the general plane containing the axles 10 and 11. In the present embodiment, this freedom is ensured by limiting the thickness of the cross-tie 44 to a value such as to permit the required flexibility between side frames and by the freedom for relative movement between means 14 and cross-tie 44 afforded by the clearance of the cross-tie in the aperture.

A pair of strut-like dampers 47 interconnect the side frames 35 and the car bolster 39. While these dampers have been omitted from FIGS. 5 and 6 in the interest of clarity of illustration, they show to good advantage in FIG. 9. Their main purpose is to damp vertical and horizontal excursion of the car body. Importantly, they are inclined inwardly and upwardly which minimizes the effect of regular vertical track surface irregularities alternately occurring on the right and left rails on lateral motion of the car body. The effectiveness of this damper orientation has been confirmed by computer simulation and full scale testing on conventional stagger jointed track.

In certain embodiments of the present invention where many sharp curves must be negotiated or where independently rotatable wheels are used, it has been found very advantageous to provide a steering link such as a tow bar which laterally interconnects one steering arm with the truck framing and body of the vehicle. The tow bar is shown schematically as link L in the diagrammatic representation of FIG. 4, and it appears as item 48 in FIGS. 5, 6 and 9. Its disposition and point of securement to the car body are unique to this invention as had already been explained with reference to FIG. 4. As can be understood in FIGS. 5, 6 and 9, the tow bar can also position the axles and truck frame longitudinally with respect to the vehicle.

As best shown in FIGS. 5 and 9, the tow bar 48 can have an arcuately formed portion 49 intermediate its ends, and this portion 49 is journaled within and cooperates with spaced arcuate flanges 50,50 carried by the central part of the upper edge of the tie-bar 44. This cooperation provides for swinging movements of the tow bar and permits the side frame assembly to serve as a point of reaction for lateral forces imposed by the connection of the ends of the tow bar to one of the steering arms and to the car body. As illustrated in FIGS. 5 and 6, the left end of the tow bar overlies the steering arm 12, which should be understood as being associated with that axle (10) which is the more remote from the center of the car body. This end is connected to steering arm 12 by pivot mechanism represented by the pin 51. The opposite end of the tow bar extends in the direction of the center of the car body, and its pin 52 is rotatably carried by a tow bar trunnion 53 secured to a portion 41*a* (FIG. 6) of the car sill structure 40 at a point lying along the longitudinal centerline of the car (FIG. 5).

In accordance with this invention and as described above with reference to FIG. 5, the point of securement of the tow bar 48 to the more remote steering arm 12 is at a point 51 whose location is a function of the truck assembly's wheelbase w, and the distance s between the two truck assemblies under a car body. The minimum value of the distance x from the truck center 49 to the point 51 should satisfy the expression $x_{min}=w^2/4(s+w)$. Another function of the tow bar is to take care of longitudinal forces between the car body and the resiliently mounted wheelsets. Such forces arise, for example, from braking and coupling impacts. In conventional freight car trucks now in common use where no tow bar is present, these forces associated with braking and coupling are passed through the bolster and side frames. If the apparatus of the present invention consisted solely of the elastic connections shown in FIGS. 1 and 2, the forces caused by coupling impacts could cause unacceptable deflections in the elastomeric pads 30 which connect the steering arms to the side frames and in the springs 38 which connect the side frames to the car body.

The tow bar of FIGS. 5–12 further serves an important function as a link influencing the steering action of the truck in response to lateral motion of the car body on springs 38, as will now be described.

FIRST EMBODIMENT STEERING ACTION

Although the primary steering action of the first embodiment (FIGS. 5–12) is briefly described by FIG. 4, the group of figures identified as FIGS. 5A, 5B, 5C, 5D and 5E more fully illustrate an additional valuable property of the steering action of the first embodiment. In these figures the body of the vehicle is indicated at VB, the body centerline also being indicated. The longitudinal center of the body would be offset to the right to those figures.

FIGS. 5A and 5B show the influence on the steering action on tangent track where linkage such as indicated at 48 is employed, such linkage being associated with the steering arms or yokes and also with the body of the vehicle and the truck framing. In FIGS. 5A and 5B, lines representing the parallel straight rails are indicated in FIGS. 5A and 5B at SR.

In FIG. 5A, it will be seen that the two axles 10 and 11 of the truck there shown are positioned in parallel relation and perpendicular to the rails SR when the longitudinal centerline of the vehicle body VB coincides with the longitudinal centerline of the truck.

Turning now to FIG. 5B, the parallel position of the wheelset will be modified either by a transient lateral displacement of the track or a latter force on the car body such as a cross wind tending to unbalance the steady or stable travel of the vehicle. This steering modification as caused by motion of the body of the vehicle VB laterally, for instance, in the direction indicated by the arrow LF shown in FIG. 5B. This lateral shifting of the vehicle body will carry with it one end 52 of the linkage 48 with consequent shifting in position of the pivot 51 with the steering arm 12 in the opposite lateral direction which is the position illustrated in FIG. 5B. Because of the mounting of the central arcuate portion 49 of linkage 48 between the arcuate surfaces 50—50 which are connected with the truck side frames through the cross-tie 44, the interconnection between the two steering arms 12 and 13 would then be caused to shift with respect to the truck framing in the direction toward the lower side of FIG. 5B with consequent shift in the angular position of the associated wheelsets. Thus, the axles of the wheelsets would shift away from parallelism with the angle between the axles widened at the lower side of FIG. 5B, as is indicated in that figure.

The result of this activity is to introduce a stabilizing steering action tending to damp out the lateral motion of the car body, improving the overall vehicle stability when travelling at high speed on a straight track.

In the case of use with conventional rotating axle wheelsets, it is pointed out that the conicity of the wheels is known to be the basic cause for hunting and instability on straight track and on gradual curves. The steering modification provided by the steering arms arranged in accordance with the present invention, together with the novel linkage interconnecting one of the steering arms with the body of the tow bar, acts to reduce the effect of the wheelset conicity thereby diminishing lateral hunting motions on straight track.

FIG. 5C illustrates the running position of the truck of FIG. 5A on curve track. FIGS. 5D and 5E illustrate the effect of unbalanced lateral forces when travelling on curved track.

In FIG. 5C, the linkage 48 is centered with respect to the centerline of the vehicle body VB. The pivot 52 connecting the link 48 with the vehicle body, and the pivot 51 connecting the link 48 with the steering arm 12, and also the joint 49–50 are all located along the centerline of the vehicle body. FIG. 5C thus illustrates the position of the truck parts under the self-steering action without the introduction of any lateral motion of the vehicle body with respect to the trackway. This is the condition present when the car is travelling on a curved track at the Balance Speed, i.e., when the increased elevation of the outer rail is exactly correct for the combination of the speed and curvature.

In the position of the parts in FIG. 5C, it will be seen that the wheelsets have assumed substantially radial positions with respect to the curvature of the curved track CR. This, of course, is an important and desired steering function achieved by the interconnected steering arms. The resilient pads 30 (not shown in FIGS. 5A-5D but illustrated in FIGS. 5-10) facilitate this self-steering function as is already explained hereinabove.

As frequently occurs in travel on curved track, forces are introduced, particularly at speeds above or below the Balance Speed, tending to shift the position of the vehicle body laterally. Such a lateral shift of the vehicle body is indicated by the arrow LF applied to the vehicle body VB in FIG. 5D. This lateral motion of the vehicle body will carry with it the pivot point 52 of the linkage 48 with consequent opposition motion of the pivot 51 which interconnects the link 48 and the steering arm 12. This lateral vehicle body motion therefore introduces a steering force into the system of interconnected steering arms for the two wheelsets and the angle between the wheelsets is diminished. In other words, when the vehicle is operated above the Balance Speed the lateral motion of the vehicle body has diminished the steering effect which the self=steering action of the interconnected steering arms tends to establish on curved trackway. It is essential that the steering respond in this manner so that high speed stability on straight track and gradual curves is enhanced.

It will thus be seen that the link 48 not only serves the tow bar function hereinabove described, but also serves to introduce a desirable balance of forces during high speed travel on straight or gradually curved track and also during travel above the Balance Speed of the vehicle on more sharply curved track.

Attention is now directed to FIG. 5E. Here the truck is travelling on curved rails well below the Balance Speed. In this condition the flanges will have a tendency to move away from the outer rail and may even engage the inner rail. This action prevents the well known tendency to flange climbing of the outer rail under conditions when the outer wheels also have a reduced vertical loading.

However, with the arrangement as shown in FIG. 5E, this low speed condition of travel on the curved track, especially where the outer rail lies substantially above the inner rail, results in a lateral force LF on the body tending to shift the body of the vehicle radially inwardly of the curved trackway. This movement of the body will react through the linkage 48 in a manner tending to increase the steering action effected by the interconnected steering arms, and this in turn automatically steers the wheel flanges of the outer wheels away from the outer rail of the curve. This will eliminate a common cause of derailment.

Similar desirable steering modifications can be obtained with other forms of the equipment herein disclosed embodying both interconnected steering arms for the wheelsets and also linkage interconnecting the steering arms with the vehicle body or with some component or structure participating in lateral motion of the vehicle body. As will be shown hereinafter, the compound action of the coordinated steering motions of the wheelsets and the motions introduced from lateral motion of the vehicle body may be achieved not only by the use of a single tow bar type of linkage, but also by other forms of linkage such as the multiple linkage described hereinafter with particular reference to FIGS. 29A-29D inclusive. In addition, similar steering modification can be obtained by orienting the $k_e$ of FIGS. 1 and 2 at an angle to the car body centerline rather than parallel to the centerline as shown.

SECOND EMBODIMENT

Reference is now made to a modified form of railway truck utilizing the invention which is particularly useful with conventional rotating axle wheelsets and illustrated in FIGS. 13-15. In this embodiment, a conventional cross bolster is embodied in the truck and imposes the weight of the car upon conventional side frames. Additionally, this truck bolster is flexibly associated with the two side frames and serves as the only interconnection between the two.

In terms of basic structure for supporting the axle-borne wheelsets, and for providing resilient damping at the axle end portions, and also between the truck and the car body, the apparatus is in many respects similar to the embodiments already described. Accordingly, like parts bear like designations with the subscript b. Thus, axles **10*b* and 11*b* are, respectively, carried by generally C-shaped steering arms 12*b* and 13*b*, and each steering arm, as was the case in the preceding embodiment, has a portion extending from its associated axle with respect to which it has a substantially fixed angularity to a common region substantially midway between the two axles. Means 14*b* couples the steering arms with freedom for relative pivotal movement and with predetermined substantial stiffness against lateral motion in the general direction of axle extension. In this embodiment, the coupling means 14*b* (see FIG. 15) comprises a pair of studs 55 and 56, each of which extends from an associated one of the steering arms toward the zone of coupling. The stud 55 carried by arm 12*b* is recessed as shown at 57, while stud 56 has a reduced, hollow end portion 58 which extends within the recess. Elastomeric material 59, preferably rubber, is interposed between extension 58 and the interior wall defining the recess 57 and is bonded to the adjoining surfaces. A bolt 60 serves to retain the parts in assembly. Again, as was the case with the preceding embodiment, the coupling 14*b***, through which the steering moments are exchanged, has considerable lateral stiffness and an angular flexibility sufficient so that each axle is free to assume a position radial of a curved track and free to adjust to track surface irregularities.

As shown in the cross-sectional portions of FIG. 13, which is taken as indicated by the line 13—13 applied to FIG. 14, it will be seen that each steering arm has journal box structure 61 at each end thereof, and in this case flanging shown at 62, projects from the journal box structure in the direction of the length of the truck. The journal box has an upper substantially flat surface 63 upon which is seated an elastomeric pad 64. These pads may be sandwiched in steel and, if desired, mounted upon the surface 63 in the manner already described with respect to FIGS. 5-8. The axles **10*b* and 11*b* are supported by structure which is of the character already described with respect to the earlier embodiment and which fits within the downwardly facing pedestal opening provided by jaws 68. In practice, means (not shown) would be provided to retain the axle and the bearing adapter structure within the pedestal opening. Brakes have also not been illustrated since, in this embodiment, they would either be conventional or be of the kind already described with respect to FIGS. 5, 6 and 9**.

In accordance with my invention, the truck side frames 65,65 are carried upon the bearing portions of the steering arms and, importantly, are supported upon the pads 64 as appears to good advantage in FIG. 14. Such pads have been shown at each end of each axle, although it will now be understood that they may be used at the ends of one axle only or that pads providing different degrees of flexible restraint may be used with each axle. These pads, as will now be understood, restrain the steering motions of the axles with respect to each other and oppose departure of the subtrucks which are comprised of the wheelsets and steering arms from a position in which the wheelsets are parallel. Each side frame comprises a vertically extending web portion 66 having horizontal flanging 67 (FIG. 13) extending laterally from each side of the web. The flanging tapers from a substantial width in the central region between the two steering arms to a relatively narrow width where the arm overlies the pads 64. Each side frame has a pedestal opening between pedestal jaws 68 (FIG. 14) which straddles the journal box assembly and is restrained thereon by cooperation with the interior surfaces 69 of flanges 62 in the manner shown in FIG. 13. Each side frame 65 is provided with a generally rectangular aperture 70 (FIG. 14), the upper portion of which accommodates the end portions 72 of a truck bolster 71 and provides a seating surface for the springs 73 (in this case six are provided), which react between the side frames 65 at 74 as shown in FIG. 14 and the undersurface of the projecting end 72 of the truck bolster 71.

The bolster extends laterally of the width of the truck and provides articulated connection means between the two side frames. In this instance no tie-bar is used. The bolster end, since they pass freely through upper portions of the side frame aperture 70, flexibly interconnect the side frames with the freedom for relative longitudinal movement which is characteristic of a conventional three-piece truck. In a center part of the bolster overlying the means 14*b* which couples the steering arms and which does not contact the steering arms 71 (see FIG. 14), there is a bowl-type receiver 75 for the car body center plate which, as will be understood by those skilled in this art, is fastened to the car's center sill, which is not illustrated. As is clear from the foregoing description, in the apparatus of this invention, the steering arm coupling means (P in FIG. 1, 14 in FIGS. 5–9, 14*b* in FIGS. 14–15 and described hereinafter with reference to other embodiments), is free for steering motions in a direction across or transversely of the truck. Thus, it is also true that lateral motion of truck parts, such as the truck bolster illustrated in FIG. 14 may occur independently of the motion of coupling means 14*b*.

To provide the resilient restraint identified as $k_e$ in the description with reference to FIGS. 1 and 2, that is, the restraint between the truck and the car body, the embodiment of FIGS. 13–15 has a pair of elastomeric pads 76,76 carried at spaced portions of the upper surface of truck bolster 71 being held there in any desired manner and are cooperable with the car bolster (not shown) which forms part of the sill structure. The function of these pads will be understood without further description. It should also be understood that a less suitable, but in some cases adequate, yaw restraint of the truck bolster can be provided by a conventional center plate and side bearing arrangement.

PRIOR ART AAR TRUCK

In considering the third and fourth structural embodiments of the invention illustrated in FIGS. 16 through 25, it should be emphasized that the invention is shown as applied by retrofitting the well-known three-piece AAR truck, which is shown in FIGS. 26–28 labelled "Prior Art".

This known truck will first be described with reference to FIGS. 26–28 It comprises a pair of conventional rotating axle wheelsets, a cross bolster 104 and a pair of spaced side frames 105 and 106. The bolster in such a truck is flexibly associated with the two side frames and pivots with reference to the car body. The brake beams are supported by the side frames, their ends being loosely received within support fittings E carried by the side frames.

Many bolsters of standard trucks have openings for a part (through-rod) of the brake rigging here indicated purely diagrammatically at 108. The brake rod extends only through one of the apertures 117 fore and aft of the bolster.

As appears in FIG. 27, the truck side frames have considerable depth in their mid-region. They are defined by a vertically extending truss which has a large, generally rectangular aperture 109 and an upper, generally horizontal chord 110 (FIG. 26) extending longitudinally to each side of the bolster and terminating in downwardly opening pedestal jaws 111 which straddle the axle journal bearing assembly 112. The latter, in conjunction with bearing adapters 113, serves to mount the wheelsets in known manner. The bearing adapters are of known type, also useable with minor modification in the retrofitted structure presently to be described. As will then be shown and described in detail, such adapters have slots or keyways within which are received flanges F (FIG. 27) which serve to position the adapter and its bearing 113 with respect to the pedestal jaws 111.

Extending between the confronting apertures 109 of the two side frame members is the mentioned bolster 104. Its outboard ends 114 are of considerable width and limited height. The width is such that said outboard ends substantially span the width of the apertures 109 and each such bolster end extends through a corresponding aperture (one appears in FIG. 27) to a position in which it projects beyond its associated side frame (105, as illustrated in FIG. 26). The height of each outboard end is such that the springs 115, which are seated upon the lower wall structure which defines aperture 109, lie beneath the outboard bolster portion 114 and support the same with freedom for some vertical travel under the imposed load.

The bolster 104 interconnects the side frames [illegible] limited freedom for relative movements. This bol[illegible] mid-region of considerable depth appears at 116 in FI[illegible] 28, which figure also shows that this region of the bolster is provided with several apertures 117, sized and positioned to accept the "rod-through" brake rigging which is conventionally used in such prior art trucks, i.e., the rigging parts above referred to and diagrammatically indicated at 108. In the center of the upper surface of the bolster is the bowl-type receiver 118 which supports the center plate 119 of the car body, shown fragmentarily at 120 (FIG. 28). Reinforced pad means 121,121 are spaced across the upper surface of the bolster and are provided to receive side bearing rollers (not shown) which contact a surface (not shown) carried by the body bolster normally provided on the understructure of the car. A wedge W, of common type, fits within the bolster end 114 (FIGS. 27 and 28), being urged upwardly by a spring 115*a* which is smaller than the springs 115.

As noted above, it is such a truck which is now in common freight use on United States' railroads, and it is to be understood that in such trucks, notwithstanding liberal clearance in the fit of the bearing adapter in the pedestal jaws and between the bolster and side frames, the wheelsets are constrained to be generally parallel by the friction between adapters 113 and side frames 105. Thus, both axles cannot assume a position radial to a curved track or an accurately parallel position on tangent truck causing the flanges of the wheels strike the rails at an angle. These trucks are, therefore, subject to all the difficulties and disadvantages fully considered earlier in this description. As noted, some efforts have been made to redesign such trucks by introducing elastic elements between the bearing adapters and side frames in order to allow the axles to assume the positions approximately radial of a curved track. Most such redesigned trucks have lacked stability at speed. Primarily, this has been because of the lack of recognition of the importance of providing the direct resilient, interaxle lateral restraint which I have found to be required to prevent high speed hunting and which also serve to enhance curving. Other efforts have been made to suppress truck hunting by restructuring the swivel of the bolster relative to the car body. However, this tends to further degrade curving.

A third approach covered by my U.S. Pat. No. 4,483,253 employs a combination truck frame rigidizing and resilient pads between the bearing adapters and the side frames. While providing less stability and steering performance than the invention described herein, it does so without requiring any supplemental restraint of bolster swivel.

However, it may in certain embodiments be desirable to make minor changes in the pedestal area of the side frames.

In accordance with one aspect of the invention, there is provided a method of retrofitting a railroad truck having rotating axle wheelsets with mechanism providing for coordination steering of the wheelsets. This method, which is described below, is practiced in the retrofitting of the AAR truck (FIGS. 26–28) to provide the trucks either of the Third Embodiment as shown in FIGS. 16–22 or the Fourth Embodiment as shown in FIGS. 23–25, the constructional features of each of which will be described.

The retrofitting method is briefly described as follows:

An existing truck is selected having load-carrying side frames with opposed pairs of pedestal jaws, within which are received the usual axle bearings and bearing adapters, the latter having load-carrying connections with the side frames and being movable with respect to the side frames independently of the other wheelset;

a generally C-shaped steering arm is applied to each wheelset;

connections are established between the adapters and free arm portions of the steering arms with each adapter interpositioned between its corresponding bearing and pedestal jaw to thereby provide for conjoint motion of each pair of adapters and its wheelset;

the steering arms are pivotally interconnected between the wheelsets to exchange steering forces between the latter and to provide for coordinated pivotal steering motions of the two wheelsets; and resilient steering motion restraining means is introduced in load transmitting position between the bearing adapters and the base ends of the pedestal jaws.

When retrofitted in the manner, a truck equipped with conventional rotating axle wheelsets is capable of smooth, quiet self-steering while maintaining stability at speed and has the physical characteristics shown, for example, in FIGS. 16–22, except that the brake equipment may be unmodified, if desired, and remain as shown in FIGS. 26–28.

Now with detailed reference to FIGS. 16–22, it should be noted that considerable structure shown in those figures also appears in FIGS. 26–28, discussed above, as will now be understood, and similar parts are, therefore, shown identified in FIGS. 16–22 with similar reference numerals. First with reference to FIGS. 16 and 17, it will be seen that the structure, after retrofitting, is provided with a pair of steering arms 122 and 123 (compare the steering arms 12 and 13 of the embodiment of FIG. 5 and the steering arms 12*b* and 13*b* in the embodiment of FIG. 13) through which the vehicle weight derived from the side frames is imposed upon the axle bearing assemblies, in the manner to be described. Each axle has a substantially fixed angularity with respect to its generally C-shaped steering arm, as is the case with the embodiments described above. As will become clear, the steering arms are coupled in a common region between the two axles. The coupling means here employed bears the designation 124 (see FIGS. 16 and 18) and, as is the case with the other embodiments, it couples the steering arms with freedom for relative pivotal movement, preferably with stiffness against lateral motion in the general direction of axle extension.

In this retrofit embodiment of the invention, the coupling means for interconnecting the steering arms is disposed slightly to one side of the vertical centerline of the bolster 104 in order that it may pass freely through one of the apertures 117 in the bolster, the other aperture 117 being used, in most cases, for a conventional brake rod.

Lateral forces between the two axles are exchanged through the coupling 124, and this coupling has a lateral stiffness which may also make a contribution to the yaw stiffness between the two axles. As was the case with the other embodiments, the coupling provides for coordination and balancing of steering moments between the two axles as well as providing the lateral stiffness. Coupling 124 may be, and preferably is, of the type shown in FIG. 15, i.e., of the type used in the embodiment of FIG. 13 and 14. However, the coupling is located differently than is the corresponding coupling of FIGS. 13 and 14. In the case of the retrofitted embodiment of FIGS. 16–22, the coupling passes through an aperture 117 (FIG. 18) which is provided in the bolster and is located somewhat off center rather than in the center as it appears in FIGS. 13 and 14. Specific description of the coupling 124 need not be repeated (compare coupling shown at 14*b* in FIG. 15), other than to record the fact that elastomeric material 125, preferably rubber, is interposed between the telescoped members which define the coupling and that a corresponding one of said telescoped members is fixed to each of the steering arms 122 and 123, as shown in FIG. 16. Thus, as was the case with preceding embodiments, the coupling 124, through which the steering moments are exchanged, has considerable lateral stiffness and an angular flexibility sufficient so that the two axles are free to assume positions radial of a curved track and free to adjust to track surface irregularities. As will be understood, it is important that this coupling pass freely and with clearance through the bolster so that it may be free for steering motions in a direction across or transversely of the truck and also that lateral motion of the truck parts, such as the bolster, may occur independently of the motion of coupling means 124 and its associated steering arms. Considered from another point of view, it will be seen that the construction is of such a nature that the coupling means and the associated steering arms are not affected by centrifugal forces transmitted to the bolster.

Turning now to the manner in which each axle is associated with its steering arm and the latter with the side frames, it will be seen, particularly from FIGS. 19–22, that each steering arm, for example, the steering arm shown at 122 (FIGS. 16 and 17), has a pair of spaced free end portions 126 which extend longitudinally of the truck in planes lying between the truck wheels and the adjacent side frame. Each of these end portions is rigidly coupled to a bearing adapter 127 through the agency of high strength bolts shown in FIGS. 16 and 17 at 128 and which appear to best advantage in FIGS. 19 and 20. Provision of apertures 129 in the bearing adapter 127 (FIG. 19) suitable to receive the bolts is a step characteristic of the preferred retrofitting procedure. A boss 130 is provided on each steering arm in a position to confront the bearing adapter 127, and the aforesaid bolts extend through the boss. In such a construction, the usual bearing adapters are used, in effect, as extensions of the steering arms, which extensions are interposed between the side frame and the bearing assembly carried between the pedestal jaws of such side frame. The adapters move with the steering arms and with respect to the side frames during axle steering.

As clearly appears in FIGS. 17 and 19 and as is the case in the illustrations of the AAR truck in FIGS. 26–28, the pedestal jaws shown at 111 are sized to receive the bearing assembly 112, the upper surface of which fits within a partially cylindrical downwardly presented surface of the bearing adapter 127 (FIG. 21). The bearing adapter has a substantially flat upper surface 131, as shown in FIGS. 19 and 20, while its lower surface is partially cylindrical as noted just above. The cylindrical, bearing-receiving surface has spaced arcuate flanges 132–132 which serve to axially locate the bearing assembly 112 with respect to the adapter and to maintain the parts in proper assembly. In this structure, the bearing adapter is provided with spaced keyways 133–133 shaped to receive, with some clearance, the projecting flanges 134–134 provided on the inward confronting surfaces of the pedestal jaws 111, as clearly appears in FIG. 21. Cooperation between these flanges and the keyways serves to position the bearing structure, and accordingly the wheelset, laterally with respect to the load-imposing side frames while permitting freedom for wheelset steering motions. An end cap 135 (FIGS. 16 and 17) is bolted to the end of the axle and completes the assembly of bearing and axle.

As will be plain from the earlier description of the retrofitting method, each adapter 127 carried by its steering arm is interpositioned between its corresponding bearing assembly 112 and the overlying surface 136 (FIG. 21) of the pedestal jaw to thereby provide for pivotal steering motion of each wheelset and consequent sliding motion of each adapter with respect to the side frame. As is characteristic of this invention, yielding pivotal motion restraining means is introduced in load transmitting position between the bearing adapters 127 and the overlying surfaces 136 which define the base end of the pedestal jaws.

Thus, in accordance with my invention, elastomeric material is interposed between the weight-carrying side frames and the bearing adapters which, in turn, form part of the steering arms, as will now be understood. In this manner consistent with the embodiments already described, the elastomeric means flexibly restrains yawing motions of the coupled pair of wheelsets, i.e., provides restraint of the steering motions of the axles with respect to each other and thus restrains departure of the subtrucks (comprising the steering arms and their axles) from a position in which the wheelsets are parallel. This restraining means may, if desired, be provided only at the ends of that axle which is more remote from the center of the vehicle. However, it is frequently desirable to provide each restraint at the ends of each axle. Accordingly, the embodiment of FIGS. 16–17 shows restraint at each axle. It can, of course, be of different value at each axle depending upon the particular truck design.

As best seen in FIGS. 17, 21 and 22, the restraining means takes the form of the elastomeric pad assemblies 137 (FIGS. 21 and 22) which are interposed between the upwardly presented flat surface 131 of each bearing adapter and the confronting lower surface 136 of the outboard end portions of each side frame in the pedestal area of the latter. The assemblies 137 comprise an elastomeric, preferably rubber, pad 138 sandwiched between thin steel plates 139 and 140 and bonded thereto. The upper plate 139 has spaced flanges 141 and 142 (FIG. 22) between which is received the portions of the side frame which extend just above the flat surface 136 of the pedestal opening. This will be readily appreciated by reviewing FIGS. 21 and 22 in the environmental showing of FIG. 17. The lower plate 140 has oppositely directed flanging 143 at each end interrupted at 144 to receive the tongues 145 projecting from the adapter, as shown in FIG. 19. The adapter, shown in perspective in that figure, has two such tongues extending from the upper portion of the adapter. When the parts are assembled (FIGS. 17 and 20), the pad assembly 137 lies upon the surface 131 with the tongues 145 fitted within the openings 144 provided in the flanging 143 of the lower plate 140. The flanges 141 and 142 of the upper plate 139 serve, of course, to locate the pad assembly with respect to the side frame, as is seen in FIG. 17. As will now be understood, the pad assembly is so located and restrained with respect to other elements of the structure that the elastomeric pad 138 is subjected to shear forces when the wheelsets tend to pivot, thereby providing the desired restraint and stability at speed.

FOURTH EMBODIMENT AND RETROFITTING

Reference is now made to FIGS. 23–25 in which there is illustrated a modified retrofit arrangement in which the usual bearing adapter may be associated with the steering arm to move therewith without being bolted to the latter. In these figures, parts similar to those shown in FIGS. 19–22 bear similar reference numerals including the subscript a.

In this apparatus, the adapter **127*a* requires no drilled apertures, such as those shown at 129 in FIG. 19, being held to the steering arm 122a through the agency of a specially configured elastomeric pad assembly 137a which may be secured conveniently by bolting to the steering arm. This pad assembly is shown in FIG. 25 and comprises upper and lower plates 139a and 140a, respectively, between which is bonded a block of suitable resilient material 138a, for example, rubber. As was the case with the earlier embodiment, the lower plate has opposed flanging 143a which span the width of the adapter and cooperate with it projecting tongues 145a to position the adapter and its axle-carrying bearing 112a** with respect to the pad assembly.

Assembly 137a has a pair of tabs 146, each of which is drilled at 147. When the parts are assembled, these apertured tabs underlie the steering arm 122a in the manner most clearly shown in FIG. 23 from the upper plate 139a has been omitted in order that the cooperation between the adapter flanging 145a and the flanging 143a of the lower plate 140a may not be obscured. Bolts 148 project through apertures provided in the steering arm and secure the arm to the tabs 146 of the lower plate. In this manner, the adapter is coupled to the steering arm through the interposed pad assembly. When the equipment is in use, as will now be understood, the side frame (not shown) lies upon the upper plate 139a being received between its flanges 141a and 142a, thus to impose the load of the vehicle upon the steering arms and axles through the pads and adapters.

From the foregoing, it can readily be seen in what relatively simple manner the AAR truck may be retrofitted by the addition of coupled steering arms and elastomeric restraining means in accordance with this invention. While such a truck may be retrofitted without effecting any change in the side frames, the axles may achieve radial position in somewhat sharper curves if the two side frames are modified to increase slightly the distance between the pedestal jaws 111 thereby to provide increasing clearance for longitudinal movement of the bearing assemblies and the bearing adapters carried thereby in the direction of the length of the side frames. Curving performance will also be enhanced if longitudinal stops S (see FIG. 21) are added along the outer edge of each pedestal opening to prevent the elastomeric pads 137 from migrating outward under the influence of repeated brake applications.

In retrofitting an existing truck in the manner shown in FIGS. 20–22, the wheelsets should be inspected particularly for matched wheel sizes and to remove any rolled-out extensions of the tread which might contact the steering arms. Also, it should be determined that the openings in the bolster 104 contain no casting flash which might interfere with the free movement of the steering arm coupling 124. In addition, it is important that the two side frames be of the same wheelbase or "button" size. If these conditions are met, no difficulty should be encountered in accomplishing the retrofit.

BRAKE RIGGING

While it is possible to use standard AAR brake rigging as shown in FIG. 26 with a retrofitted truck of the kind shown in FIGS. 16–18 (care being taken to ensure that rigging is so positioned as not to interfere with the free movement of the coupling 124), the retrofit embodiment of FIG. 17 lends itself well to the improved braking which is described below with reference to FIGS. 7, 8 and 8a.

Making detailed reference to the unique braking apparatus characteristic of the invention and to the advantages which are achieved thereby. In prior brake apparatus commonly used in the railroad art, the brake beam is supported by an extension member which rides in a slot in the truck side frame. This system has several substantial drawbacks. The friction created at the slot interferes with precise control of the force between the wheel tread and the brake shoe, and the radial distance between the friction face of the shoe and its point of support in the slot results in an overturning moment on the brake shoe which, in turn, causes large variations in the unit pressure between the shoe and the wheel tread along the length of the shoe face. Another problem with conventional brake rigging is the large lateral clearance between the brake beams and the car truck side frames. With conventional trucks this clearance is required to prevent high lateral forces which would occur if the distortion of the truck framing in curves is limited by contact between the brake shoes and the wheel flanges. The above problems can combine to produce unsymmetrical wear of the two wheels in each wheelset, the one wheel having excessive flange wear, the other having excessive wear of the tread and, in some cases, wear of the outside corner of the wheel leading to overheating and occasional derailment due to wheel failure.

In the braking arrangement shown in FIGS. 7, 8 and 8a, these disadvantages are overcome primarily because the association of the brake beams with the steering arms makes it possible virtually to eliminate uneven wear at the shoe and completely to prevent any contact between the shoes and the wheel flanges. Since the brake beams 24 are carried by hangers 27 which are supported in pad structures 28 formed integrally with the steering arms (instead of on the truck frames or bolster), and because of the fixed angular relationship between the wheelsets and the steering arms, the brake pads 26 always remain properly centered with respect to the wheel treads.

FIG. 8a shows how the proper choice of geometrical relationships can be used to provide two different values for the braking force B on the leading and trailing wheelsets. This compensates for the transfer of weight from the trailing to the leading wheelset during braking. Thus, providing this compensation reduces the risk of wheel sliding. The braking effect on the lead wheelset $B_L$ is made larger than the braking effect on the trailing wheelset $B_T$ by choosing a centerline for the hanger structure 27 which is inclined with respect to a line t, which is tangent to the wheel surface at the center of the brake shoe face. Referring to the two force polygons which comprise FIG. 8a, it can be seen that the effect of the mentioned angle is to create an angle between the vectors $R_L$ and $B_L$ and the vectors $R_T$ and $B_T$. The presence of these angles causes the normal force $N_L$, between the shoe and the lead wheel, to be larger than the force $N_T$ between the shoe and the trailing wheel. It is necessary to have the same ratio between the normal forces N and the braking forces B for both wheelsets, and the ratio is established by the coefficient of friction chosen for the brake shoe material and the steel face of the wheel.

The total force applied to the brakes is shown in the drawings by arrows appearing on the brake beam linkage in FIGS. 7 and 8. As shown by the force polygon, the braking force applied to the beam linkage at the leading or right hand wheelset is $F_2$, while the force applied to the linkage at the trailing wheelset is represented in the polygon as the equal and opposite $F_1$. Since two brake shoes are actuated by each beam assembly, the arrow showing brake actuator force is labelled on the trailing wheelset as amounting to $2F_1$. As will be understood, this force can be supplied by any convenient conventional means, including, for example, a connection extended through an aperture through the bolster such as the aperture 117 through which the conventional "throughrod" 108 previously extended. Such connection serves adapted to apply the force in the direction of the arrows shown on the center strut of the brake beam structure.

In retrofitted trucks spaced steering arm extensions 126 may extend outwardly of each end of the truck a distance sufficient to provide for application of the brakes at the outside surfaces of the wheels of each wheelset. These are the surfaces which, at any instant, are substantially the furthest removed from the center of the truck as measured in the direction of the truck travel. Such extensions have been incorporated in the embodiment of FIGS. 16 and 17, and it will be seen that the brakes 149 are fixedly carried by downwardly extending brake arms 150 which have special configuration to couple them pivotally to free, upwardly hooked ends 151 of the extensions 126. This configuration is such that the upper end of each brake arm 150 is provided with a pair of vertically spaced flanges 152 which form a slot 153 (left side of FIG. 17) within which is received the steering arm extension 126 and its hooked end 151.

As is the case with the brake structure described above with respect to FIGS. 7, 8 and 8*a*, the brake beams 107*a* extend between and are associated with the shoe mounting structure in such manner that the position of each brake is fixed with respect to its corresponding wheel. This prevents brake misalignment and flanged wear problems which characterize the prior art brake rigging in which the beams are carried by the side frames. Apparatus for actuating the brakes would, of course, be provided. This apparatus would serve to displace the brake beams 107*a* and 107*a*. The brake apparatus of FIGS. 16 and 17, like that shown in FIGS. 7, 8 and 8*a*, substantially reduces brake shoe wear and results in much safer braking.

FIFTH EMBODIMENT

The fifth embodiment illustrated in drawings in FIGS. 29A, 29B, 29C, 29D, 30, 31, 31 and 33 is used with conventional rotating axle wheelsets. The structure of the fifth embodiment is described below with particular reference to FIGS. 29A, 30, 31, 32 and 33, and the steering action of the fifth embodiment is thereafter described with particular reference to FIGS. 29A, 29B, 29C and 29D.

In connection with the general arrangement or structure of the fifth embodiment, it is first pointed out that this embodiment utilizes a truck structure incorporating two axled wheelsets, each of which is provided with a steering arm in accordance with the general principles hereinabove fully described. The fifth embodiment also incorporates linkage interrelating lateral motions of the vehicle body to the steering action of the wheelsets. As fully described hereinabove with reference to FIGS. 5A and 5E inclusive, the invention contemplates an interrelation between the lateral motion of the vehicle body and the steering motion of the wheelsets in the following manner. Thus, when travelling on straight or tangent track, if the vehicle tends to hunt or oscillate as sometimes occurs, particularly at high speeds, the resultant lateral motion itself of the body of the vehicle is utilized through the use of interconnecting linkage or tow bar mechanism to introduce corrective steering action between the intercoupled wheelsets. As fully described above in connection with FIGS. 5A-5E, the steering action introduced as a result of hunting of the vehicle body tens to counteract or diminish the hunting whether this occurs at either low or high speed or on curved or tangent track.

Moreover, when the truck of the fifth embodiment (FIGS. 29A-33) is operating on a curved track above the Balance Speed, the vehicle body tends to move outwardly of the curve, and the linkage or tow bar mechanism automatically provides for diminution of the self-steering action of the wheelsets and the interconnected steering arms. When the vehicle is travelling on a curved rail path below the Balance Speed, the laterally inward movement of the vehicle tends to increase the steering action. These actions of the fifth embodiment, both on straight track and on curved track, are further explained with reference to FIGS. 29A-29D after description of the structure of the fifth embodiment in connection with FIGS. 29A, 30, 31, 32 and 33, as follows.

In the fifth embodiment, the axles are indicated at 160 and 161, each axle having a pair of flanged wheels 162 adapted to ride on rails such as indicated at R in FIG. 30. The vehicle body is indicated at VB. In FIG. 29A, the diagrammatic indication of the rails at SR indicates a portion of trackway having straight rails.

Each wheelset is provided with a steering arm of the kind described above, these arms being indicated at 163 and 164, each steering arm carrying bearing adapters cooperating the respective wheelsets in the manner described above. The truck further includes side frames 165 and 166, the ends of which rest upon the portions of the steering arms associated with the wheel bearings. A resilient pad 167 is located between each end of each side frame members 165 and 166 and serves the function described above for resiliently opposing departure of the wheelsets from parallel relation under the influence of the self-steering action which occurs when the truck is riding curved trackway.

The side frames also have centrally located pads 168 which receive load from the vehicle body through the bolster indicated at 169. The bolster in turn receives the load of the vehicle body through cushions of known type indicated at 170. The position of the bolster with relation to the car body is maintained by the drag links 171, these links being flexibly joined to the vehicle body as indicated at 172.

With the arrangement of the major truck components, the bolster and the vehicle body in the manner described above, the bolster does not yaw relative to the vehicle body but flexibility is permitted to accommodate lateral motions originating with lateral forces. Lateral motion between the truck side frames and the bolster is limited or controlled by the link 173 which is pivoted at 174 (see FIGS. 29A, 30 and 33) to the side frame 165 and which is pivoted at 175 with the bolster.

The major components of the truck structure briefly described above conform with generally known types of truck construction and many specific parts of such structures are also described hereinabove with reference to the embodiments previously described.

Turning now to the steering functions of the truck of the fifth embodiment, it is first pointed out that the steering arms are interconnected substantially midway between the axled wheelsets by means of a joint indicated generally at 176 (see particularly FIGS. 31 and 33). This joint included a pivot pin 177 and spherical ball and socket elements 178 and 179 with an intervening resilient element 180. Therefore, the steering arm interconnection provides not only for pivotal motion of the steering arms with respect to each other about the axis of the pin 177, but also provides for angular shift of one of the wheelsets in a vertical plane with respect to the position of the other wheelset.

As fully brought out above, the steering arms and the interconnection thereof is provided in order to insure coordinated substantially equal and opposite yawing movement of the steering arms and thus also of the wheelsets under the influence of the self-steering forces.

Attention is now directed to the arrangement of the linkage interconnecting the steering arms and the vehicle body in order to influence the self-steering action of the wheelsets when travelling on curved trackway and in addition when the vehicle body moves laterally relative to the truck framing.

The linkages employed in the fifth embodiment, as shown in FIGS. 29A–33, include linkage parts serving the same fundamental functions as the linkage parts including tow bar 48 and associated mechanism, as described above, with reference to the first structural embodiment shown in FIGS. 5–12. Moreover, the fundamental action of the linkage parts about to be described in connection with FIGS. 29A–33 is essentially the same as the functioning of the first embodiment as described with reference to FIGS. 5A, 5B, 5C, 5D and 5E. However, the linkage now to be described as embodied in the fifth embodiment is a multiple linkage instead of a single link as in the first embodiment, and this multiple linkage arrangement is adapted for use in various truck embodiments where clearance problems would be encountered if only a single tow bar link was employed as in the first embodiment.

In the following description of the multiple linkage arrangement of the fifth embodiment, particular attention is directed to FIGS. 29A, 30, 32 and 33. A lateral or double-ended lever 181 is centrally pivoted as indicated at 182 on the steering arm 163, this pivot 182 being spaced between the joint 176 between the two steering arms and the axle 160 of the outboard wheelset. A link 183 interconnects one end of the lateral lever 181 with a bracket 184 secured to and depending from the vehicle body VB, spherical pivot joints being provided at both ends of the line 183 to accommodate various motions of the connected parts. Similarly, the other end of the lateral lever 181 is connected by a link 185 with a bracket 186 secured to and depending from the vehicle body VB. Pivot or flexible joints are again provided at the ends of the line 185.

A reference link 187 is provided between the link 185 and the bolster 169. As best seen in FIGS. 29A and 33, the reference link is pivotally connected at one end with the link 185 and pivotally connected at is other end with a bracket 188 adapted to be mounted on the underside of the bolster 169. The ends of the line 187 are desirably flexibly and pivotally connected with the link 185 and the bracket 188 and, in certain embodiments, it is provided with several alternative positions for adjustment of its longitudinal position of the link 187 with respect to the link 185 and the bracket 188. For this latter purpose, several different fastening apertures are provided in the bracket 188 and in the line 185, as clearly illustrated in FIGS. 29A and 33. This permits adjustment of the influence of lateral vehicle body motion on the steering action of the interconnected wheelsets.

Pivoted links 189 between the steering arm 163 and the side frames 165 and 166 aid in maintaining appropriate interrelationships of those parts under the influence of various lateral and steering forces.

FIFTH EMBODIMENT STEERING ACTION

The steering action of the fifth embodiment is illustrated in FIGS. 29A–29D and reference is first made to FIGS. 29A and 29B which illustrate the steering action occurring as a result of lateral movement of the vehicle body relative to the truck framing on straight track at high speeds. As seen in FIGS. 29A and 29B, the track on which the truck is travelling comprises straight rails as indicated at SR. In FIG. 29A, all of the parts of the truck including the axled wheelsets, the steering arms and all of the linkage interconnecting the vehicle body and the steering arms are located in the mid or neutral position, representing a stable state of travel on straight track without hunting or oscillation. All of the truck parts are thus located symmetrically with respect to the centerline of the vehicle as shown on the figure.

In FIG. 29B, the vehicle body is shown as being shifted in position as indicated by the arrow LF, thereby shifting the centerline of the vehicle upwardly in the figure as is indicated. FIG. 29B thus shows the vehicle body VB shifted laterally with respect to the various truck components, including the bolster 169. Because of the presence of the link 187 between the link 185 and the bracket 188 which is carried on the bolster 169, this lateral motion of the vehicle body with respect to the truck parts introduces a steering motion between the axled wheelsets so that the axled wheelsets now assume relatively angled positions being closer together at the upper side of FIG. 29B than at the lower side thereof. This results in introduction of a steering action which tends to neutralize the wheel conicity which in turn minimizes steering activity on straight track which otherwise could lead to hunting of the truck or car body.

FIGS. 29C and 29D show a comparison similar to that shown in FIGS. 5C and 5D. The activity of the steering parts when travelling on a curved trackway as indicated by the curved rails CR. In FIG. 29C, the effect of the self-steering action of the wheelsets is shown in the absence of lateral displacement of the vehicle body, i.e., with the vehicle travelling at the Balance Speed. It will been seen from this figure that the curved track has set-up steering forces which have caused the wheelsets to assume substantially radial positions with respect to the curved track, the angle of the wheelsets with respect to each other representing a substantial departure from parallelism as is plainly evident from the figure.

In FIG. 29D, the vehicle body has been shown shifted again in the direction indicated by the arrow LF as would occur by outward movement of the body when travelling above the Balance Speed. The effect of this is to shift the position of the steering arms in a direction to diminish the steering action. As appears in FIG. 29D, the steering arms and the wheelsets are in positions representing an appreciable reduction in the angle between the wheelsets.

The arrangement of FIGS. 29A–33 also functions for the purposes described above with respect to FIG. 5E.

In the fifth embodiment, the linkage serves to influence the steering action as in the single tow bar embodiments previously described and also serves as tow bar linkage as in the other embodiments but, in the fifth embodiment, the linkage constitutes multiple tow bar linkage. It is also to be understood that separate linkages serving the steering and tow bar functions may be employed.

SIXTH EMBODIMENT

FIGS. 37–40 illustrate an embodiment of the invention which in certain important aspects is similar in construction to the embodiment of FIGS. 1 and 2 and in other aspects similar to FIGS. 29A–29D and 30–33 with modifications which are provided for utilization of the invention in a truck having independently rotating wheels.

In reference to FIGS. 37–40, this embodiment utilizes two axled wheelsets in which the wheels 162' are independently mounted for rotation on axles 160' and 161' by bearing means comprising roller bearings 210.

As in the fifth embodiment, each axle is provided with a steering arm indicated at 163' and 164' and joined as before described. Since the axles in this embodiment are non-rotating, the ends of each steering arm may be bolted directly to the axle or to a saddle 211 which is secured to the axle as illustrated in FIG. 40. The truck also includes side frames 165' and 166' which are positioned inboard of and adjacent to the wheels of each wheelset. A resilient pad 167' is located between each end of each side frame 165' and 166' for support of the frames on the axles and for resiliently opposing departure of the wheels from the parallel relation. In the embodiment of FIGS. 37–40 where there is no torque transmitted through the axle as there is when wheels are fixed to the axles, it is of importance that the pads 167' on the end of the truck frames adjacent the end of the car be relatively less stiff than the pads spaced at the ends of the frame adjacent the car center to allow the lead axle to more readily assume a radial position as it enters a curve.

The truck is provided with a transversely extending bolster 169' having a center opening for receipt of the projecting standard center plate on the car body. The function of the opening is to position the truck longitudinally and laterally of the car. The weight of the car is carried by spherical spring pads or cushions 170', such as spring pads manufactured by the Lord Corporation under the trademark Lastosphere, which are mounted on pedestals on the side frames 165' and 166'. The pads 170' transmit the load through the bolster through conventionally located side bearing plates on the car which interengage with low friction plastic bearing surfaces on bearing plates 218 of the bolster. As can be best seen in FIG. 39, pads 170' are tilted angularly inwardly from a vertical axis thereby effectively resisting the various lateral forces to which the car body is exposed on both curved and tangent track. The tilted orientation of the springs is especially effective in reducing the car body roll angle in curves and assists in wheel load equalization on twisted track and on stagger jointed track.

Supplementary suspension damping is provided by hydraulic shock absorbers 212, only one of which is illustrated in FIG. 39. The roll position of each side frame in turn is controlled by a cross web 213 which is interconnected to the side frame on the opposite side of the truck by means of a pin 214. The pins 214 allow for relative patching movement of the side frames with respect to each other, thereby accommodating various vertical irregularities in the track surface. As can best be seen in FIG. 39, each cross web is provided with an opening 215 at the centerline of the car to allow for interconnection of the steering arms as in the previous embodiments. Openings 216 and 217 disposed beneath the opening 215 allow for passage of the brake rigging.

A further advantage of the embodiment of FIGS. 37–40 is that the tow bar linkage is not required. Because of the elimination of axle torque existing when wheels are fixed to the axles, axle steering can easily be supplied by the ratio of the longitudinal stiffnesses of pads 170' and 167' as indicated by $k_e$ and $k_a$ of FIGS. 1 and 2.

In summary, the sixth embodiment of the invention provides a truck of reduced weight, which may be lighter than the lightest weight conventional truck despite the fact that steering arms have been added. Although substantial weight reduction is achieved through the use of an inboard bearing arrangement as in the preceding embodiment, even more weight reduction is achievable through the use of independently rotatable wheel. When the reduction of torque through the axles is substantially eliminated, the size of the axles may be reduced. The use of the tilted elastomeric spring supports which carry the car load at four spaced apart locations provides improved control of car body roll and allows for a reduction of bolster weight since the bolster no longer has to transmit load laterally from the center plate.

SEVENTH EMBODIMENT

FIGS. 34–36 illustrate various aspects of the seventh embodiment. Only certain parts are shown in these figures, but it is to be understood that the arrangement is to be employed in association with other truck features, for instance, the linkages and various parts included in the fifth embodiment of FIGS. 29A–33.

In general, what is included in the seventh embodiment comprises a special form of mechanism adapted to resist relative yaw deflection of the steering arms of the truck. It will be recalled that in various of the embodiments described above, resilient pads are employed between the steering arms and the side frames of the truck, such pads being indicated by the numeral 30 in FIGS. 5–7 and also figures of the fifth embodiment. Those resilient pads yieldingly resist or oppose relative deflection of the steering arms and serve to exert a force tending to return the steering arms to the positions in which the wheelsets are parallel to each other. In some applications, sliding surfaces have been placed in series with the resilient pads to limit forces in sharp curves as explained by FIG. 3.

I have found that it is desirable to employ in combination with such resilient pads and sliders some additional means for resisting relative deflection of the steering arms, and a mechanism for this purpose is illustrated in FIGS. 34–36. This means provides non-linear restraint of interaxle and truck frame yaw motions as provided by this invention according to FIG. 36.

In FIGS. 34 and 36, the steering arms are indicated at 163 and 164 and the steering arm interconnecting joint is indicated at 176 (these reference numerals being the same as used in the illustration of the fifth embodiment).

A pair of devices generally indicated at 190 are employed in the seventh embodiment, one of these devices being shown in section in FIG. 35. Each of these devices comprises a cylindrical spring casing 191 in which a helical compression spring 192 is arranged, the spring reacting between one end of the casing 191 and also against an adjustable stop device 193 arranged at the other end of the device. A cylindrical cup 194 is positioned within the spring and has a flange 195 against which the spring reacts, urging the cup flange 195 against the adjustable stop 193. A plunger 196 extends into the cup 194 and is adjustably associated with the rod 197 by means of the threaded device 198. At the other end of the system a rod 199 is connected with the base end of the cylinder 191 and the two rods 197 and 199 are extended toward the steering arms 163 and 164, as clearly appears in FIG. 34. Each of these mounting rods is connected with the associated steering arm by means of a pivot 200 carried by a fitting 201 which is fastened to the respective steering arms. A resilient device, such as a rubber sleeve 202, serves as the interconnecting element between the associated rod and its pivot 200. The resilient sleeves 202 are capable of deflection and are intended to contribute the relatively high resistance to the initial deflection of the steering arms from the parallel axle position in the manner explained more fully below with reference to FIG. 36.

The spring 192 is preloaded or precompressed between the base of the cylinder 191 and the flange 195 of the cup 194. The plunger 196 is separable from the cup 194 but is positioned in engagement with the base of the cup in the condition shown in FIG. 35. The length of the assembly shown by FIG. 35 is adjusted by the threaded connection between parts 196 and 198 so that the sleeves 202 are brought approximately to point A in FIG. 36 when the axles are parallel. When the steering arms are separated at the side thereof to which the respective device 190 is located, the load in the bushing 202 is reduced and will ultimately become zero and the plunger 196 will be partially withdrawn from the cup 194. An air cylinder under a preset pressure may alternatively be used in place of the spring 192.

When the steering arms deflect toward each other at one side, the deflection resisting device at that side comes into action to resist the deflection. Because of the presence of the resilient or rubber sleeves 202, the initial portion of the deflection builds up to a substantial value very rapidly even with a relatively small amount of deflection. When the load exceeds the preload in spring 192, it will be compressed to a shorter length than shown with a more gradual increase in the resistance than would otherwise be required to obtain the same deflection in sleeves 202.

The combined use of both the resilient sleeves 202 and the preloaded spring 192 results in a pattern of resistance to steering arm deflection which is generally diagrammed in the graph of FIG. 36. The total range of deflection of the resilient sleeves 202 is relatively small as compared with the total range of deflection provided by the helical spring 192, but the rate of increase of resistance contributed by the resilient sleeves 202 is relatively high per unit of deflection; and the rate of increase of resistance contributed by the spring 192 is relatively low per unit of deflection. This net result is indicated in the graph of FIG. 36. The combined effect of the two such assemblies is to produce the force (R) -deflection ($O_B$) characteristic shown in FIG. 3.

In the normal position of the parts for small angular motion of the axles, the end of the plunger 196 will exert a nominal force on the base of the cup 194 and only the resilient sleeves 202 will be active.

The high rate of increase of resistance in the initial portion of the deflection is important in providing high speed steering stability on straight track and in gradual curves. The change to a lesser rate of increase for large deflections prevents wheel/rail flange force and the forces within the truck assembly from becoming excessive in sharp curves.

EIGHTH and NINTH EMBODIMENT

Reference is first made to FIGS. 41 and 42 which illustrate a truck of the kind shown in FIGS. 13–15.

Briefly stated, the truck comprises conventional rotating axle wheelsets **10*b* and 11*b*, a conventional cross bolster 71 and side frames 65. The ends of the bolster fit through openings 70 in the side frames and flexibly and yieldably interconnect to the side frames by means of groups of coil springs 73. The axles carry generally C-shaped steering arms 12*b* and 13*b* which are interconnected by coupling means 14*b*. As explained above in reference to FIG. 4, the end of each steering arm has journal box structure 61 on which is seated an elastomeric pad 64. The truck side frames 65 are carried on the steering arm bearing portions via the elastomeric pads 64. In the truck of FIGS. 41 and 42, the pads are provided at the ends of each axle and the pads on the two axles preferably provide the same degree of flexible restraint. As further explained above in reference to FIGS. 13–15, elastomeric pads 76 are carried at spaced positions on the upper surface of each truck bolster 71 and are cooperable with elements on the bolster portion of the car sill structure as a means for providing the resilient restraint identified as $k_e$ in the description of FIGS. 1 and 2**. These elastomeric pads are spaced approximately 25 inches from the center of the truck as is established by AAR Standards.

In FIGS. 41 and 42, the resilient supports 76 are shown by dotted lines to indicate that they are to be eliminated and to further illustrate their standard position.

In contrast to the truck of FIGS. 13–15 and as a sole means of support of the car body in the embodiment illustrated in FIGS. 41 and 42, the center plate of the car body bolster is provided with laterally extending, structurally rigid support portions 220 which engage spaced apart support pads 221 secured to the upper surface of the truck bolster 71. The support portions may take the form of steel plates welded to the car center plate or body bolster and have downwardly facing wear portions **220*a* overlying the support pads 221**.

Preferably, four such support pads 221 are provided on the bolster as is illustrated on the top surface of the truck bolster 71, there being two pads mounted on the surface on each side of the bowl-type receiver 75, as can best be seen in FIG. 42. It will be apparent from FIGS. 41 and 42 that each such pad location is substantially inboard from the standard side bearing locations, the locations being preferably from between about 12 inches to about 16 inches from the centerline of the truck. By the provision of four such support pads, two-point support can be provided on the truck at each end of either articulated cars or non-articulated cars. In the event of use of the truck under articulated cars, the end of one articulated car would use locations 1 and 3, whereas the end of the adjacent car would use locations identified as locations 2 and 4. Single, non-articulated cars would be supported on the pads at the locations identified as locations 2 and 3. In the truck as shown in FIGS. 41 and 42, support surfaces of pads 220 and 221 are preferably made of steel or other non-resilient material and may be coated with a suitable plastic wear-reducing surface layer, such as high density polyethylene or TEFLON impregnated fabric material as is known in the art.

It will be apparent that the pads act to provide a four-point suspension for the car body and are dimensioned and positioned so that they can carry all of the weight of the car, none being carried by the car body center plate. It is pointed out that a four-point suspension of the car body with the points well displaced from the car centerline is the ideal suspension for the prevention of rocking and tilting. However, in a conventional three-piece truck which lacks steering arms, this arrangement increases the truck swivel torque which in turn can cause excessive truck parallelogramming.

It has been found that when the truck is equipped with steering arms as illustrated in FIGS. 41 and 42, suspension at points spaced on the bolster from about 12 inches to about 16 inches from the centerline may be provided, thereby improving resistance to rocking, tilting and wheel lift off without causing truck frame parallelogramming and excessive flange wear in curves. Thus, the features of the truck of FIGS. 41 and 42 are ideal for high center of gravity cars.

With reference now to FIGS. 43 and 44, a further modification to the truck of FIGS. 13–15 is illustrated. In FIGS. 43 and 44, four-point suspension of the car body is provided for as in FIGS. 41 and 42, although it is to be understood that the modifications to be described hereinafter may be used on the truck of FIGS. 13–15 independently of the four-point suspension offered by the features of FIGS. 41 and 42.

According to FIGS. 43 and 44, the spring support in side frames 65 is modified to permit swing or pendulum movement relative to the bolster, thereby allowing the side frames to function as swing hangers. As in FIG. 13, the truck side frames 65 are supported on resilient pads 64, the pads also being illustrated in FIGS. 43 and 44. In the embodiment of FIGS. 43 and 44, it is important that there be a pad at the end of each axle, since the pads provide a resilient pivotal support relative to the bearing adapters providing for swinging movement of the side frames in a manner to be described.

As explained above in FIGS. 13 and 14, the ends of the bolster 71 extend through generally rectangular openings 70 in each side frame. In FIGS. 43 and 44, the lower surface of each opening 70 is a separate part 231 which is supported by resilient pads 230 to provide for relative roll motion between the side frame and the spring group 73 and bolster 71.

The combination of the resilient pads 64 between the axle and the pedestal jaw portions of the side frames and the resilient support 230 between the side frames and the bolster springs 73 allows the side frames to function in effect as pendulums or swing hangers which move in unison about pivot points established by the resilient pads 64 and 230 in response to lateral forces. For purposes of illustration, the broken lines extending between the pads 64 and the pads 230 illustrate the effective swing hangers. The swing hangers reduce the stiffness of the car body suspension in the lateral direction thereby substantially improving ride quality and further enhancing truck stability.

The combination of the features of FIGS. 41–44 in a conventional side frame truck produces a truck of excellent stability and ride quality and makes the benefits of soft lateral springing inherent in the embodiments of FIGS. 5–12, 29A–35, 39 and 40 available in a conventional side frame, outboard bearing, spring group truck.

I claim:

1. A truck for support of a railway vehicle, the truck being adapted to be mounted between the center and the end of the vehicle;

said truck comprising two axle-borne wheelsets, each having the wheels of each set mounted fixedly on an associated axle for rotation therewith;

main truck framing comprising a pair of spaced apart, generally parallel load bearing side frame elements;

said truck further comprising a transversely extending load carrying bolster, support springs resiliently mounting said bolster on said side frame elements;

a steering arm for each wheelset, each said steering arm having a connection to the axle of an associated wheelset at locations spaced adjacent the wheels, each said steering arm having a portion extending from its associated wheelset to a common region substantially midway between the two axles;

means in said common region pivotally intercoupling said steering arms independently of the truck framing and providing for coordinated substantially equal and opposite yawing movements of the steering arms and consequent positioning of the associated axles substantially radially of a curved path;

resilient elements interposed between said framing and said steering arms resiliently opposing departure of said steering arms from a position in which said wheelsets are parallel; and vehicle support elements on the upper surface of said bolster, said vehicle support elements being offset from the center of the bolster substantially equidistantly and cooperating support elements on the underside of said railway vehicle, said support elements on the bolster and the vehicle being in pairs with the support elements of each pair being interengageable and providing the sole means of support of the vehicle on the truck.

2. A truck according to claim 1 further including yieldable spring support means supporting said bolster support springs on said side frame elements, said resilient elements and said yieldable spring support means allowing for lateral swinging movement of the side frame elements about said resilient elements.

3. A truck according to claim 2 wherein said yieldable spring support means for said bolster support springs comprise laterally yielding elastomeric pads.

4. A truck according to claim 2 wherein said vehicle support elements are positioned from about 7 inches to about 15 inches laterally of the center of the bolster.

5. A truck for a railway vehicle, the truck being adapted to support the vehicle at a location spaced between the center and an end of the vehicle;

said truck comprising at least two axle-borne wheelsets, each having wheels mounted fixedly on an associated axle for rotation therewith;

main truck framing comprising a pair of spaced apart, generally parallel load bearing side frame elements;

said truck further comprising a transversely extending load carrying bolster, bolster spring means resiliently interconnecting said side frame elements with the ends of said bolster, said bolster spring means resiliently supporting the bolster on the frame elements at locations intermediate the ends of each said side frame element;

a steering arm for each wheelset, each said steering arm having a connection to the axle of an associated wheelset at locations spaced adjacent the wheels of the associated wheelset, each said steering arm having a portion extending from its associated wheelset to a common region substantially midway between the two axles;

means in said common region pivotally intercoupling said steering arms independently of the truck framing and providing for coordinated substantially equal and opposite yawing movements of the steering arms and consequent positioning of the associated axles substantially radially of a curved path;

first resilient elements interposed between said framing and said steering arms resiliently opposing departure of said steering arms from a position in which said wheelsets are parallel, said resilient elements further providing resilient support for said side frame elements; and second resilient elements supporting said bolster spring means on said side frame elements, said first and second resilient elements permitting lateral and roll motion of the side frame elements relative to the axles and bolster.

6. A truck according to claim 5, further including spaced apart vehicle support elements on the upper surface of said bolster, said vehicle support elements being offset from the center of the bolster on opposite sides thereof and cooperating support elements on the underside of said railway vehicle, said support elements on the bolster and the vehicle being in pairs with the support elements of each pair being interengageable to provide the sole means of support of the vehicle on the truck.

7. A truck for a railway vehicle on which the truck is adapted to be mounted between the center and an end of the vehicle;

said truck comprising two axle-borne wheelsets, each having wheels mounted fixedly on an associated axle for rotation therewith;

main truck framing comprising a pair of spaced apart, generally parallel load bearing side frame elements;

said truck further comprising a transversely extending load carrying bolster;

spring means resiliently mounting the bolster on said side frame elements;

steering means comprising a steering arm for each said axle borne wheelset, each said steering arm having a connection to the axle of an associated wheelset, each said steering arm having a portion extending from its associated wheelset to a common region substantially midway between the two axles;

means in said common region pivotally intercoupling said steering arms independently of the truck framing and providing for coordinated substantially equal and opposite yawing movements of the steering arms and consequent positioning of the associated axles substantially radially of a curved path, said steering means for positioning of the associated axle of the axle borne wheelsets substantially radially of a curved path, said steering means including resilient means interposed between the axles and the framing for resiliently opposing departure of said wheelsets from parallel positions;

vehicle support elements on the upper surface of said bolster, said vehicle support elements being offset from the center of the bolster substantially equidistantly and cooperating support elements on the underside of said railway vehicle, said support elements on the bolster and the vehicle being in pairs with the support elements of each pair being interengageable and providing the sole means of support of the vehicle on the truck.

8. A truck for a railway vehicle, said truck being adapted to be mounted between the center and the end of the vehicle:

said truck comprising two axle-borne wheelsets with the wheels of said wheelsets mounted fixedly on associated axles for rotation therewith;

main truck framing comprising a pair of spaced apart, generally parallel load bearing side frame elements;

said truck further comprising a transversely extending load carrying bolster, bolster spring means resiliently interconnecting said side frame elements with the ends of said bolster, said bolster spring means resiliently supporting the bolster on the side frame elements at locations intermediate the ends of each said frame element;

steering means for said axle borne wheelsets, said steering means providing positioning of the associated axle of the axle borne wheelsets substantially radially of a curved path, said steering means including resilient means for resiliently opposing departure of said wheelsets from parallel positions;

first resilient elements interposed between said framing and said steering arms resiliently opposing departure of said steering arms from a position in which said wheelsets are parallel, said first resilient elements further providing resilient support for said side frame elements; and second resilient elements supporting said bolster spring means on said side frame elements, said first and second resilient elements permitting lateral and roll motion of the side frame elements relative to the axles and bolster.

* * * * *